US005371990A

United States Patent [19]

SalahUddin

[11] Patent Number: 5,371,990

[45] Date of Patent: Dec. 13, 1994

[54] ELEMENT BASED FOAM AND CONCRETE MODULAR WALL CONSTRUCTION AND METHOD AND APPARATUS THEREFOR

[76] Inventor: Fareed-M. SalahUddin, One Eaton Court, Marboro, N.J. 07746

[21] Appl. No.: 928,268

[22] Filed: Aug. 11, 1992

[51] Int. Cl.[5] ..... E04B 5/00

[52] U.S. Cl. ..... 52/379

[58] Field of Search ..... 52/378, 379, 729, 733

[56] References Cited

U.S. PATENT DOCUMENTS

| | | | |
|---|---|---|---|
| 1,307,779 | 6/1919 | Johnson . | |
| 1,499,171 | 6/1924 | Green . | |
| 1,501,288 | 7/1924 | Morley . | |
| 1,537,278 | 5/1925 | Wilson | 52/379 |
| 1,583,077 | 5/1926 | Long . | |
| 1,757,077 | 5/1930 | Eiserloh . | |
| 1,900,541 | 3/1933 | Buelow | 52/729 X |
| 1,930,951 | 10/1933 | Dotson . | |
| 2,233,089 | 2/1941 | Adler . | |
| 2,326,708 | 8/1943 | Wanner . | |
| 2,363,164 | 11/1944 | Waller | 52/729 X |
| 2,776,559 | 1/1957 | Summers . | |
| 2,841,975 | 7/1958 | Bruckmayer . | |
| 2,856,766 | 10/1958 | Huntley | 52/378 |
| 3,127,702 | 4/1964 | Karstedt . | |
| 3,255,562 | 6/1966 | Altschuler . | |
| 3,285,444 | 11/1966 | Reilly | 52/729 X |
| 3,292,331 | 12/1966 | Sams . | |
| 3,383,817 | 5/1968 | Gregori . | |
| 3,389,521 | 6/1968 | Gregori . | |
| 3,410,044 | 11/1968 | Moog . | |
| 3,420,023 | 1/1969 | Gregori . | |
| 3,483,665 | 12/1969 | Miller | 52/729 X |
| 3,511,000 | 5/1970 | Keuls . | |
| 3,552,076 | 1/1971 | Gregori . | |
| 3,654,742 | 4/1972 | Wilnau . | |
| 3,717,967 | 2/1973 | Wood . | |
| 3,755,982 | 9/1973 | Schmidt . | |
| 3,782,049 | 1/1974 | Sachs . | |
| 3,783,569 | 1/1974 | Roussin | 52/729 X |
| 3,788,020 | 1/1974 | Gregori . | |
| 3,800,015 | 3/1974 | Sachs . | |
| 3,950,902 | 4/1976 | Stout . | |
| 3,979,867 | 9/1976 | Sowinski . | |
| 4,038,798 | 8/1977 | Sachs . | |
| 4,070,845 | 1/1978 | Cody | 52/729 X |
| 4,909,001 | 3/1990 | de Los Monteros . | |
| 4,091,587 | 5/1978 | Depka . | |
| 4,112,646 | 9/1978 | Clelland . | |
| 4,163,349 | 8/1979 | Smith . | |
| 4,211,045 | 7/1980 | Koizumi et al. . | |
| 4,211,385 | 7/1980 | Johanson et al. . | |
| 4,223,501 | 9/1980 | DeLozier . | |
| 4,249,354 | 2/1981 | Wynn . | |
| 4,295,415 | 10/1981 | Schneider, Jr. . | |
| 4,314,431 | 2/1982 | Rabassa . | |
| 4,357,783 | 11/1982 | Shubow . | |
| 4,461,130 | 7/1984 | Shubow . | |

(List continued on next page.)

FOREIGN PATENT DOCUMENTS

| | | | |
|---|---|---|---|
| 2436575 | 2/1975 | Germany . | |
| 613853 | 12/1960 | Italy | 52/378 |

OTHER PUBLICATIONS

International Search Report by EPO dated Jan. 6, 1994.

*Primary Examiner*—Carl D. Friedman
*Assistant Examiner*—Beth A. Aubrey
*Attorney, Agent, or Firm*—Finnegan, Henderson, Farabow, Garrett & Dunner

[57] ABSTRACT

A bond beam Channel structure and Pilaster Channel structure for use in forming wall structures of blocks are provided. Each Channel structure comprises a pair of Channel members. A plurality of elongated ties connect the two Channel members together, defining a space therebetween. The space allows concrete to be poured between the Channel members, providing structural integrity to the wall structure. Each tie includes a slot configured to receive at least one rebar in a position substantially transverse to the tie, for providing additional structural integrity to the wall structure.

23 Claims, 13 Drawing Sheets

U.S. PATENT DOCUMENTS 4,486,993 12/1984 Graham et al. .
4,532,745 8/1985 Kinard .
4,541,211 9/1985 Garrett .
4,587,782 5/1986 Shubow .
4,614,071 9/1986 Sams et al. .
4,616,459 10/1986 Shubow .
4,625,484 12/1986 Oboler .
4,628,650 12/1986 Parker .
4,630,419 12/1986 Pilgrim .
4,698,947 10/1987 McKay .
4,706,429 11/1987 Young .
4,730,422 3/1988 Young .
4,731,968 3/1988 Obino .
4,731,971 3/1988 Terki .
4,742,655 5/1988 Kovasna .
4,742,659 5/1988 Meilleur .
4,759,160 7/1988 Fischer .
4,774,794 10/1988 Grieb .
4,802,318 2/1989 Snitovski .
4,823,534 4/1989 Hebinck .
4,832,308 5/1989 Slonimsky et al. .
4,854,097 8/1989 Haener .
4,860,515 8/1989 Browning, Jr. .
4,862,660 9/1989 Raymond .
4,884,382 12/1989 Horobin .
4,889,310 12/1989 Boeshart .
4,894,969 1/1990 Horobin .
4,924,641 5/1990 Gibbar, Jr. .
4,967,528 11/1990 Doran .
4,981,003 1/1991 McCarthy .
4,987,719 1/1991 Goodson ..... 52/378 X
5,014,480 5/1991 Guarriello et al. .
5,024,035 6/1991 Hanson et al. .
5,038,541 8/1991 Gibbar, Jr. .
5,050,358 9/1991 Vladislavic ..... 52/252 X
5,060,446 10/1991 Believeau .
5,086,600 2/1992 Holland et al. .
5,189,860 2/1993 Scott ..... 52/729

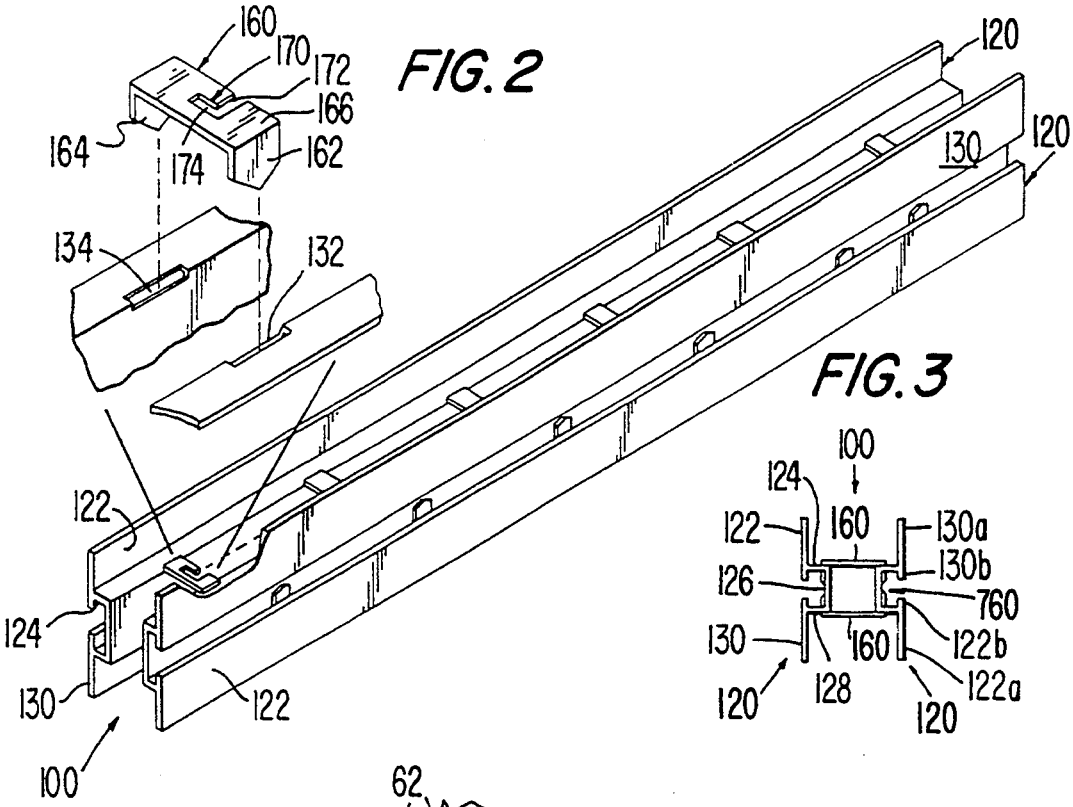
FIG. 2
FIG. 3
FIG. 4
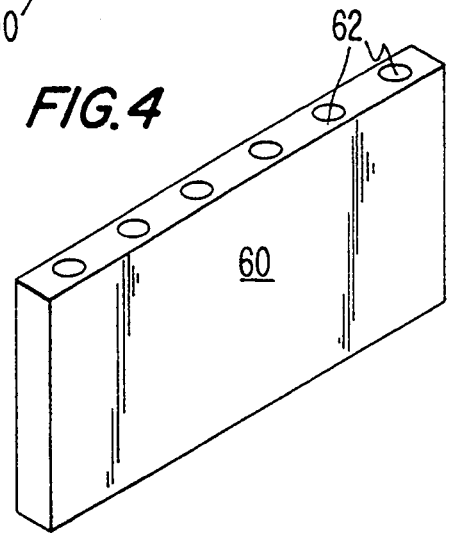
FIG. 5
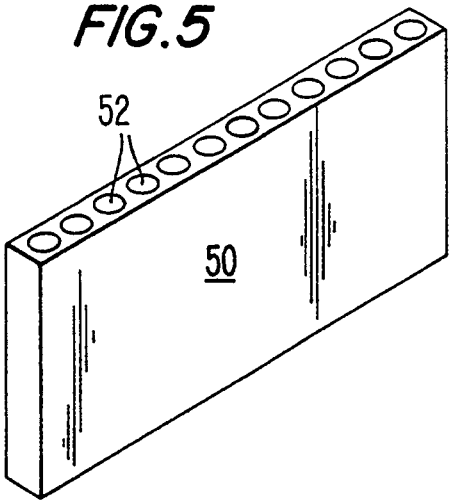

300
320
310
324
322
326
332
360
320
328
330

300'
310'
320'
322'
332'
330'

222
220
218
216
212b
212a
214
260
246
160
248
244
250a
250b
242b
242a 200
280
282
284
270
250
246
242
240
210

200
100
200
100
100
60
60
50
50
300'
300
300'
400
400
400
540
510
540
510
412
412
412
412
432
532
520
510
512
532
532
542
542
540
460
440
560
532
570

830
240
240
832
210a

830

610
100
60
200

610
100
60
200

100
622
200

ELEMENT BASED FOAM AND CONCRETE MODULAR WALL CONSTRUCTION AND METHOD AND APPARATUS THEREFOR

BACKGROUND OF THE INVENTION

1. Field of the Invention

The invention relates to the field of element based modular building construction, using walls made of foam or other inexpensive polymeric insulating material, in or between which concrete vertical and horizontal columns and beams are formed at the construction site.

GLOSSARY OF TERMS

As used herein, the following terms shall have the meanings set forth below:

"Block" or "Insulating Block" means an elongated block of foam insulating material, preferably a polymeric.

"Channel" means a form in which to pour concrete to define a concrete beam.

"Code" means the Uniform Building Code and applicable federal, state and local building codes.

"Joists or Trusses" means wooden I-beams or any other structural components used to support floors or roofs of a structure.

"Pilaster" means a beam that includes a projecting, substantially coextensive ledge.

"Rebar" means an elongated reinforcing bar, used for concrete and usually made of steel.

"Substantially Continuous Pour" means a concrete pour which can be performed substantially continuously until completed, assuming availability of concrete and acceptable working conditions, such as light, temperature.

2. Prior Art

Many attempts have been made to develop relatively inexpensive fabrication techniques for avoiding the high skill, labor-intensive traditional methods of constructing homes and small buildings. To the extent that inexpensive materials, which may be assembled relatively quickly by unskilled laborers, are feasible, the time required to construct a building and the attendant costs, both for labor and the money invested in land and building materials, can be considerably reduced.

The prior art teaches many different ways to attempt to avoid the time-intensive and skilled labor-intensive techniques of building construction which are traditionally used. However, these approaches have achieved only limited success, because they have not sufficiently minimized labor, time and costly materials used in building construction. They have been too slow and too expensive.

One of the interesting techniques for constructing relatively inexpensive housing and other buildings is described in U.S. Pat. No. 4,532,745 to Kinard. In that patent, a concrete and polystyrene foam block wall construction is illustrated. Cylindrical, vertically extending apertures are molded or formed in each block. Each course of foam blocks is separated from its vertically proximate course by U-shaped wooden channels, which have core holes drilled therethrough in alignment with the cores or apertures in the foam blocks. The wooden channels serve to space the blocks, and permit the creation of horizontal, rectangular beams in the space between vertically aligned blocks, and act as fastening surfaces for mounting sheet rock or siding.

In the Kinard patent, horizontal reinforcing bars are located in the concrete channels and in the vertical columns.

In Kinard, single courses of foam Blocks and wooden channels are formed, held together by wooden braces, reinforcing bars are inserted, and the concrete is poured, one course at a time. Before a course is formed, a Rebar is inserted in each aperture, spliced in place, and foam Blocks and wooden channels placed over the Rebars. This process is repeated for each course. Each course must be braced and aligned with other courses before concrete is poured.

The methods and structures disclosed by Kinard, although useful, are commercially impractical, because they are still too inefficient to assemble and construct. In addition, several features of the Kinard process and structure create a construction which will not meet applicable Code standards. Among the limitations of the Kinard construction and process are:

1. The expense and inconvenience involved in pouring each course separately.
2. The requirement to construct an elaborate bracing structure, to hold the insulating blocks in place, before and during the pouring and setting of the concrete. This bracing structure restricts movement and placement of the scaffolding necessary to place the concrete.
3. Lack of ability to conveniently locate plumbing and electrical conduits.
4. Lack of a teaching for sealing joint corners, so that concrete, when poured, will not leak.
5. Failure to provide teachings to permit use of the steel reinforcing bars in ways that meet Code requirements.
6. Requires the use of Rebars which are the height of the proposed wall or manually splicing the Rebars at each course, making the process labor intensive.
7. Lack of a teaching for aligning subsequent Block courses with one another horizontally.
8. Failure to provide a method for plumbing the wall structure in either the horizontal or the vertical directions.
9. Lack of the ability to integrate structural bearing components or elements easily into the wall construction process, or the final wall assembly.

U.S. Pat. No. 5,038,541 to Gibbar, Jr. shows a poured concrete form construction, in which external sheets of polymeric foam, and discrete polymeric interior foam spacers, form a mold. Concrete is poured into the mold and allowed to harden. This structure and system is cumbersome and time-consuming to assemble, and has some of the same limitations as the Kinard patent.

U.S. Pat. No. 4,731,971 to Terkl shows a construction for creating poured concrete walls, involving a pre-formed framework of polystyrene-concrete panels, which may be assembled on site for the insertion of poured concrete. The invention of Terkl, which involves the conveyance of the pre-formed panel elements to the construction site, is awkward and cumbersome to handle and use.

U.S. Pat. No. 4,742,659 to Meilleur shows wall modules created of plastic foam components, which must be interlocked, before concrete is poured, by the use of complex, cumbersome and expensive reinforcing bar coupling rods. Again, this construction is expensive and cumbersome.

U.S. Pat. No. 4,981,003 to McCarthy shows wall panels of expanded polystyrene beads, including structural members of two-by-four studs incorporated in the polystyrene form. This construction does not contemplate the use of concrete to provide structural integrity and strength to the wall structure.

LIMITATIONS OF THE PRIOR ART

The prior art techniques for forming relatively inexpensive wall structures have been impractical, in many instances, and economically limited, for the following reasons, among other:

a. They are difficult to erect and often require the cumbersome, expensive and time-consuming erection of bracing means to hold them in place during the assembly and pouring process, and the removal and storage of these heavy and costly bracing means.

b. In some instances, they must be formed and concrete poured in courses, making the process slower and more expensive than desirable.

c. Often, the construction does not comply with applicable Codes.

d. The wall constructions do not include convenient provision for plumbing or electrical conduits and wiring, which must be separately handled.

e. They do not provide facilities for easily hanging interior and exterior wall coverings, such as sheet rock or plasterboard, on the inside, and vinyl or other exterior siding.

f. They often require relatively customized components, with expensive fabrication and assembly costs.

g. They often do not provide easy means for capping joints and corners, to prevent "blowout" when concrete is poured.

h. They do not provide convenient structures and means for attaching floor and roof joists and trusses to the wall structure.

i. They often require unitary Rebars which are the height of the entire wall, making the construction process difficult to use.

j. They do not provide convenient means for incorporating structural bearing columns into the wall assembly during construction of the wall.

BRIEF SUMMARY OF THE INVENTION

The invention has several aspects. They are:

1. Standardized bond beam and Pilaster Channels, splices and end caps, used for casting concrete beams. The Channels, splices and end caps are relatively inexpensive to fabricate, easy to install and erect, and provide a sealed structure, avoiding blowout during concrete pour and the requirement of expensive bracing components or systems.
2. A wall construction which is effective, relatively inexpensive to erect and provides integral means for easily supporting floor and ceiling Joists and Trusses and for mounting interior and exterior wall surfaces.
3. A wall construction which includes integral recesses for hanging junction boxes and electrical and plumbing wiring and conduits beneath the surface of the sheet rock interior walls and exterior siding.
4. A process for constructing building walls which allows all interior and exterior wall forms to be erected quickly and then completed with a Substantially Continuous Pour, and is thus easy, quick and relatively inexpensive to effect.
5. A wall construction which allows wall supports and floor and roof supports to be incorporated directly into the construction, and provides a convenient means to incorporate structural columns, if desired, into the wall assembly process and the final wall construction.
6. A wall construction which includes anchors for mounting sheet rock or siding.
7. An interlocking bond beam Channel structure, which provides for vertical and horizontal alignment of the Insulating Blocks, and a means of interconnecting them, for ease of aligning the wall structure, so that it can be easily adjusted for "trueness" (plumb) in the horizontal and vertical directions simultaneously.
8. A wall construction which includes an easily attachable and reusable system for bracing and stabilizing the Blocks during the erection process and for final precise adjustment of Insulating Blocks and interlocking Channels prior to, during and after the pouring of concrete.
9. A wall construction which includes integral door and window frames, and, if desired, structural columns, which can be formed during erection, ready to receive final assemblies.
10. A bond beam Channel, and means for adjusting the same, cast into the basement or ground floor footing of a structure, to create a level base for the entire wall structure of the invention prior to erection.
11. A bond beam tie, which permits Code-required vertical Rebars to be retrofitted into the Insulating Block apertures after erection of the entire wall or at each floor level, simplifying Insulating Block and bond beam Channel erection.
12. A wall construction which is easily adapted to incorporate structural bearing columns.

SUMMARY OF THE INVENTION

Bond beam and Pilaster Channels

One aspect of the invention is the bond beam and Pilaster Channels. These Channels are forms which are relatively inexpensive to produce, easy to assemble, and, when assembled, provide a closed structure which will withstand the pressure of a concrete pour. The Channel structure will easily orient Rebars, so they are properly located for structural strength and to meet Code requirements. Three basic Channel structures for horizontal bond beams, vertical bond beams and Pilasters—and appropriate end caps and splices—are used for all shapes and sizes of buildings. The bond beam and Pilaster Channels of the invention comprise spaced Channel elements, which engage and support the adjacent Blocks of insulation material, and are themselves held together by suitable ties. The ties are aligned to engage and support Rebars in proper position within the Insulating Blocks.

In a preferred embodiment of the invention, vertical Channels permit the creation of concrete vertical bond beams, further securely integrating the concrete elements of the structure. The vertical bond beams are recessed with respect to the interior and exterior surfaces of the Insulating Blocks, to provide vertical recesses for plumbing conduit, electrical wiring and the like. The vertical bond beams need not extend through the entire elevation of a story of a building. They may only extend part of the way up if they are only to contain floor level electrical outlets. They will extend higher if wall mounted fixtures are required or if plumbing is mounted in the bond beam recesses. The vertical bond beams may also extend to the full height if they are to serve as concrete structural bearing columns; in this event, the tie length will correspond to the actual size of the overall column to be formed, and the protruding portion will be filled with dimensional lumber, or a prefabricated panel of appropriate size.

The concrete horizontal and vertical bond beams formed by the Channels are narrower than the Insulating Blocks (unless a bearing column is created), so that recesses are provided between Blocks, at the bond beams. Plumbing conduit, electrical wires, electrical junction boxes and the like are mounted in these recesses. This means that wallboards can be hung flush against the interior surfaces of the Blocks and external decorative covering, such as siding, can be hung flush against the exterior surfaces of the Blocks, without having to make separate allowance for hanging wires, plumbing and junction boxes.

Pilaster Beams

A Pilaster beam construction is provided for each floor level and roof level. This construction serves two purposes. First of all, the Pilaster beam Channel provides an inwardly extending pouring lip at each floor or roof level; this is the access area for the introduction of concrete to the entire wall structure. In this way, concrete may be poured into the Pilaster, and, since the entire wall structure of apertures and Channels is in fluid communication, there is no need to pour different courses of the wall at different times. Thus, an entire wall structure of a building may be formed in a Substantially Continuous Pour in a single day, saving time and money. The Pilasters also provide inwardly projecting concrete lips, which will support the floor and ceiling Joists and Trusses. In one embodiment of the invention, anchor plates used to mount the floor and ceiling Joists and Trusses are locked in the concrete forming the Pilasters before the concrete is fully set, securing those anchor plates; the floor and ceiling Joists and Trusses are later secured to these anchor plates, supported by the concrete Pilasters.

The Wall Structure

The wall structures of this invention comprises spaced cylindrical concrete columns interconnected by horizontal concrete bond beams. In a preferred embodiment, vertical concrete bond beams connect horizontal bond beams. Insulating Blocks occupy the spaces between and among bond beams and columns. The vertical faces of the Insulating Blocks extend beyond the interior and exterior surfaces of the concrete bond beams, defining horizontal and vertical recesses at the bond beams. The recesses provide areas for mounting plumbing conduit, electrical wire, junction boxes and the like. Vertical pipes are inserted and run through the Pilaster Channels (through suitably drilled holes) and electrical wires are run around the Pilaster Channels and between floor Joists or Trusses.

Centrally located in all of the concrete columns and beams are reinforcing bars, which are located to provide a structural, unitary wall and building construction which will meet applicable Codes.

Wall Anchors

The wall construction includes plastic wall anchors with end barbs. These anchors are inserted horizontally into Insulating Blocks and project into the column-forming cylindrical apertures therein. Interior and exterior plastic anchors are inserted before any concrete is poured, so that the anchors easily pass through the relatively soft material of the Insulating Blocks. Thus, they are securely anchored in the concrete after it is poured and cured. The anchors provide a secure surface for attaching siding and sheet rock, by nails or screws fastened into the anchors.

Process

The invention includes a process for creating walls of Insulating Blocks and concrete, involving the steps of:

a. Constructing a concrete basement or footing, including a course of horizontal bond beam Channels, with L-shaped Rebars, and placed and leveled before concrete is poured.
b. Placing courses of Blocks with cylindrical vertical apertures extending therethrough around the periphery of said basement or footing, over the Rebar dowels and seated in the first course of bond beam Channels.
c. Inserting Channels between vertically spaced courses of Blocks to define closed, horizontal recesses spaced inwardly from the vertical surfaces of said Blocks;
d. Sealing said Blocks and Channels to define a closed system, except for Pilasters projecting at each floor level and the roof level; and
e. Substantially Continuously Pouring concrete into said Pilasters and thereby into said Channels and apertures to create a unitary concrete structure.

In the preferred embodiment of the invention, reinforcing bars are centrally located in the horizontal bond beam Channels as they are assembled. The Rebars are inserted in the vertical apertures in Blocks, after an entire wall structure has been erected, but prior to concrete pour.

In the preferred embodiment of the invention, the bond beam and Pilaster Channels are interlocked and sealed to form a substantially closed, substantially unitary structure in fluid communication. In order to provide stability to the wall form, before and during concrete pour, guy wires or ropes are releasably attached from the ground to the interior and exterior surfaces of the bond beam Channel structure, to secure the wall structure, and provide a means of final adjustment of the wall structure. The guy wires or ropes are then easily removed for reuse, once the concrete has been poured and set.

In a preferred embodiment of the invention, many elongated, nail-like thermoplastic anchors are inserted through the Insulating Blocks. Each anchor has a head which overlies the surface of the Block and a tip projecting into the cylindrical apertures. When the concrete sets, the tips of the anchors are locked in the concrete. Sheet rock or siding can then be screwed or nailed to the plastic anchors.

In another preferred embodiment of the invention, suitable means, such as anchor plates, are inserted in the Pilasters for the floor and ceiling Joists and Trusses. The anchor plates may be put in place and mounted on the Pilasters before concrete is poured or after the concrete is poured, but before it is fully set, so that fastening means for the anchor plates may be easily pushed into the only partially set concrete of the Pilasters. This avoids the need to manually hammer or screw in fastening means after the concrete is fully hardened. In this way, the anchor plates are securely locked in the concrete, with minimal effort. The Joists or Trusses are then nailed or otherwise fastened to the anchor plates after the concrete has fully set.

ADVANTAGES OF THE INVENTION

The invention provides the following advantages, among others:

1. A relatively low-cost interior and exterior wall construction, for building affordable housing.
2. The material costs for the wall structure of the invention is relatively low, due to the use of standardized components of low cost materials.
3. The erection cost for the wall structure of the invention is relatively low.
4. Erection may be done relatively quickly, with the use of unskilled laborers.
5. The invention allows a complete interior and exterior building wall structure form to be erected first, and the concrete then poured, in a Substantially Continuous Pour, usually in a single day.
6. The construction of the invention allows concrete beams, reinforcing bars and concrete columns to be constructed to provide an extremely strong, unitary structure, which meets applicable Code requirements at a relatively low materials cost.
7. The Pilaster Channel construction of the invention allows the wall structures to be poured in a single, Substantially Continuous Pour. It also permits the floor and ceiling Joists and Trusses to be secured by fasteners inserted in the Pilasters, after that concrete has been poured and partially set, but before it is fully set.
8. The wall structure of the invention has built-in plastic anchors, which provide for easy mounting of internal and external decorative wall surfaces, such as plasterboard and vinyl siding.
9. The invention provides for the creation of recesses, at the bond beams, and beneath the interior and exterior surfaces of the Insulating Blocks. These recesses permit plumbing conduits, electrical wiring, junction boxes and the like to be mounted below the surfaces of the Blocks, without interfering with the adjacent mounting of surface covers, such as wallboard and siding, and without creating significant additional expenses.
10. The wall structure and process of the invention permit the accurate placement of reinforcing bars in the concrete columns and beams, so that the reinforcing bars are optimally utilized, and provide optimum structural reinforcement, and permit the Rebars to be inserted in place in the Blocks after the entire wall structure has been erected, by threading the Rebars through apertures in the ties for the Channels.

OBJECTS OF THE INVENTION

It is therefore an object of the invention to provide a wall construction and process which significantly improves the prospect for creating relatively low-cost, affordable housing.

A further object of this invention is to provide affordable housing which is safe and sturdy, and will meet all applicable Codes.

Another object of the invention is to provide a wall construction and process which utilizes relatively low-cost materials and unskilled labor, while providing a sturdy and attractive basic structure.

Yet another object of the invention is to provide a wall structure and process which are relatively quick and easy to assemble, using standard, prefabricated Insulating Blocks and bond beam and Pilaster Channel components.

An additional object of the invention is to provide a wall structure and process for which concrete for an entire building wall structure can be poured in a single, Substantially Continuous Pour.

A concomitant object of the invention is to provide a wall structure and process which permit floor and roof Joists and Trusses to be securely fastened in the concrete structure.

Still another object of this invention is to provide a wall construction which incorporates plastic anchors, embedded in the concrete, providing easy fastening access to the wall for the purpose of fastening external surfaces, such as wallboard and siding.

A further object of the invention is to form the openings for door and window assemblies in the wall structure.

An additional object of this invention is to provide easily installed and reusable adjustable bracing for the wall structure.

An additional object of the invention is to permit the wall structure to be easily adapted to create concrete columns which will support girders, when required to allow for-say-large window walls or to mount girders. Girders are often required when an open space is incorporated at a floor level.

These and other objects of the invention will become apparent after reading the following specification, when considered in view of the appended drawings.

DRAWINGS

In the drawings:

FIG. 2 is a partially exploded perspective view of a horizontal bond beam channel;

FIG. 3 is an end view of a horizontal bond beam channel;

FIG. 4 is a perspective view of an Insulating Block, in accordance with this invention, with cylindrical apertures on 16-inch centers;

FIG. 5 is a view, similar to FIG. 4, of an Insulating Block, but with cylindrical apertures on 8-inch centers;

DETAILED DESCRIPTION OF THE INVENTION

Introduction

Figure 1:
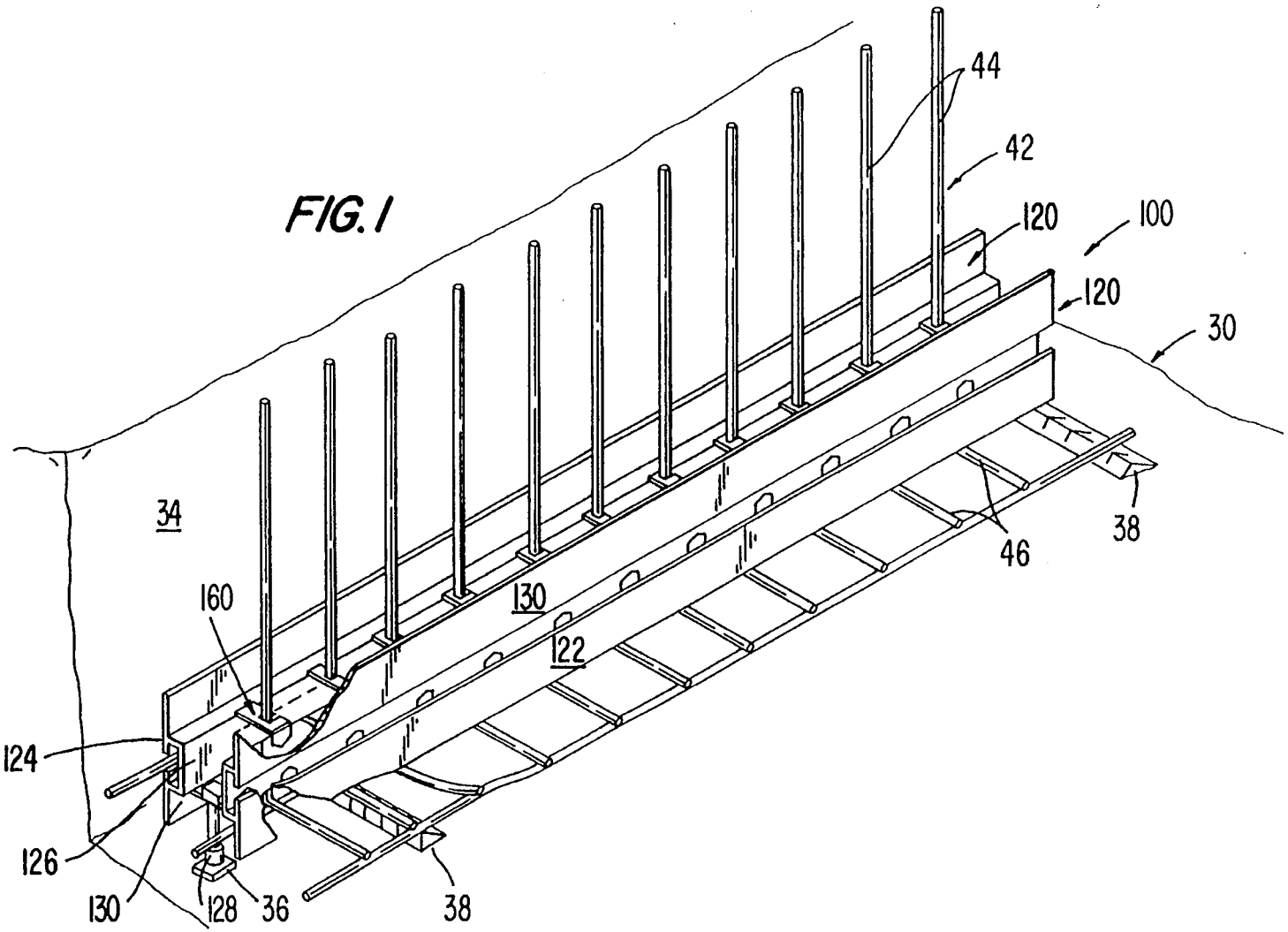
FIG. 1 is a fragmentary perspective view of an excavated footing incorporating an initial course of horizontal bond beam Channel replete with L-shaped Rebar dowels, in accordance with this invention.

This invention relates to an element based interior and exterior modular wall structure, a process for creating the wall structure and improvements in wall structures. The wall structure is composed of blocks of polystyrene foam or other insulating material, containing poured-in-place reinforced concrete columns and beams. The concrete columns and beams are the structural elements of the wall and the Insulating Blocks act as forms for the columns and insulate the walls of the ultimate building.

It is to be noted that, although the description illustrated is generally directed to exterior wall structures, as will be seen below, the exterior wall structures are combined with interior wall structures, also created in accordance with this invention, to form a building. The processes and articles of this invention may be used to create low-cost single-family and multiple-family homes, garages, storage buildings, commercial buildings and structures for virtually any sort of application. They may be constructed in all climates and geographic areas of the world.

The basic elements of the wall structures are:

1. Horizontal and Optional Vertical Bond Beam Channels. These Channels act as the molds for forming concrete horizontal bond beams, which secure the vertical concrete columns and, if desired, vertical concrete bond beams. Horizontal Channels are generally designated 100 and vertical Channels 300.
2. Pilaster Channels. Pilaster Channels 200 are a specialized type of bond beam Channel, used at every floor and roof line. They serve two functions. First, they provide the conduits for pouring concrete, which permits an entire structure to be poured in a Substantially Continuous Pour. Second, after the concrete is poured and sets, they allow floor and roof Joists and Trusses to be directly supported by the Pilasters, preferably by anchor plates fastened into the concrete of the Pilasters and inserted prior to concrete pour or while the concrete is setting.
3. Splices and Caps. These are bond beam and Pilaster Channel splice members 400 and 500 (the splices) that connect intersecting bond beam and Pilaster Channels, and members 440,460, 560 and 570 that act as end cap members (the caps), so that a closed, sealed structure of bond beam Channels and Insulating Blocks is created, except for pouring access at the Pilaster Channels. Thus, when concrete is poured, it cannot leak and is confined to flow through openings in the apertures of the Insulating Blocks and in the bond beam and Pilaster Channels.

4. Wall Anchors. These anchors 710 may be standard, commercially available plastic anchors, inserted through the Insulating Block 50 or 60 material into the internal cylindrical column apertures 52 or 62, and having a tip which projects into the aperture. When the concrete is subsequently poured and sets, the tip of the plastic anchor, which is preferably barbed, is securely fastened in the concrete. The head of the plastic anchor sits flush on the surface of the Insulating Block, and serves as a fastening surface for attaching wallboard or siding or structural elements, such as kitchen sink brackets or outdoor lighting fixtures, to the wall structure of the invention, by the use of screws or nails fastened into the anchor.
5. Insulating Blocks. These Blocks 50 and 60 are the standard sections of insulating material, preferably foam bead polystyrene, which are commercially available in standard sizes. These Blocks serve several functions. First of all, they serve as forms for molding the vertical cylindrical concrete columns that provide a significant part of the structural strength of the wall. Secondly, because the foam has a high "R" value, it serves as a heat and sound insulator, rendering the building being constructed more efficient because it is well insulated. Third, they act as a surface for mounting sheet rock and siding.
6. Rebars. Rebars 28 are preferably standard, commercially available, elongated cylindrical steel bars. They are mounted inside the vertical columns and in the bond beams and Pilaster Channels, and are formed into the concrete columns, bond beams and Pilasters, to provide reinforcement and to structurally tie together the components of the concrete wall structure into a unitary, load-bearing structure which meets Code requirements.
7. Window and Door Units. These are preferably standard, commercially available units or assemblies which are mounted in suitably defined apertures in the wall structure, to complete the structure of a building.

Detailed Discussion of the Elements

1. Horizontal Bond Beam Channels. FIG. 1 illustrates a horizontal bond beam Channel of the invention. Each horizontal bond beam Channel 100 has three discrete components. They are:

a. Front bond beam Channel member 120;
b. Rear bond beam Channel member 120; and
c. A multiplicity of ties 160.

The front and rear Channel members 120 are identical, but one is reversed from the other when used to create a bond beam Channel. Each Channel member 120 is composed of five surfaces. Opposed vertical flanges 122 and 130 are interconnected by the C-shaped connecting section, made up of horizontal members 124 and 128 and vertical member 126.

At each internal right-angle bend between members 124 and 126 on the one hand and 126 and 128 on the other hand are spaced slots 132, closed by flaps 134. The slots are located on eight-inch centers. The flaps 134 are normally closed, to prevent concrete leakage, until they are displaced by insertion of legs 162 or 164 of the tie members 160, as discussed below.

In a preferred embodiment of the invention, the height of flanges 122*a* and 130*a* is $1\frac{1}{2}$ inches and the height of central flange member 126 is six inches. Lips 124 and 128 have a preferred depth of $1\frac{1}{2}$ inches. The length of each Channel member 120 is eight feet. Each Channel member 120 desirably includes one inch vertical flanges 122*b* and 128*b*; the flanges are used to mount sheet rock covers for the plumbing and electrical recesses 760, as described below.

Figure 31:
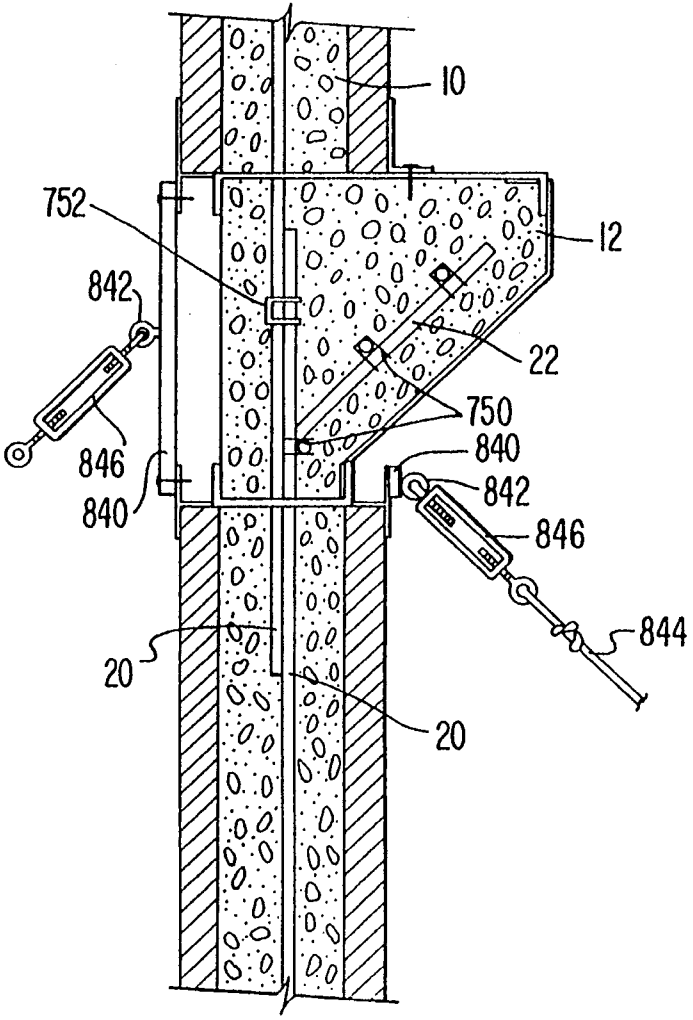
FIG. 31 is a fragmentary view, similar to FIG. 30, showing the Pilaster beam construction in cross-section, with guy turnbuckles attached.

As illustrated in FIG. 2, each of the ties 160 has a pair of depending legs 162 and 164 and a central member 166. In the middle of the central member is an L-shaped slot 170, having a section 172 proximate the edge and an internal section 174. Each slot 170 is of such dimensions (slightly wider than the Rebar diameter) that it will snugly accommodate up to three vertical Rebars, serve to guide the Rebars when they are inserted into the wall structure, and hold the Rebars in vertical alignment at the centers of the Block apertures 52 and 62 which, when filled with concrete, constitute cylindrical concrete columns 8 and 10, as seen in FIG. 31. The slots 170 guide, orient and hold the Rebars in place. The ties 160 also secure the two bond beam Channel members 120 together in the correct spatial relationship. The dimensions and location of the horizontal Channel members 120 and cylindrical apertures 52 and 62 in the Blocks is such that Rebars inserted through the ties 160 will be centrally located in the apertures 52 and 62.

Horizontal member 166 of each tie 160 is preferably five inches long, so that when concrete is poured between the two bond beam Channel members 120, a bond beam of rectangular cross-section (preferably $5'' \times 6''$) is formed.

As seen in FIG. 2, slots 132 in each bond beam channel are located approximately eight inches apart, but only alternate upper and lower slots are occupied by ties, so that the upper and lower ties are located sixteen inches apart in staggered relationship. A tie is also desired at each end of the top of the bond beam, to secure the splices—or end caps—(described below) to the bond beam Channels 100. Thus, the horizontal bond beam Channels, when assembled and capped, form a unitary structure which will accommodate an Insulating Block snugly within flanges 122 and 130, below and above the bond beam Channel.

When the bond beam Channel members 120 are about to be placed above the Insulating Blocks, the ties 160 are first hammered in place, through slots 132, creating a tight fit therebetween. As they are hammered in place, points 166 displace closure flaps 134. Those slots 132 that do not have tie legs projecting through them are closed by the flaps 134; this prevents leakage of concrete through the slots when the concrete is poured.

Figure 44:
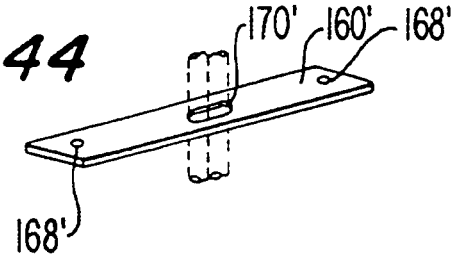
FIG. 44 is a perspective view of an alternate tie construction of this invention, showing Rebars in phantom.
Figure 43:
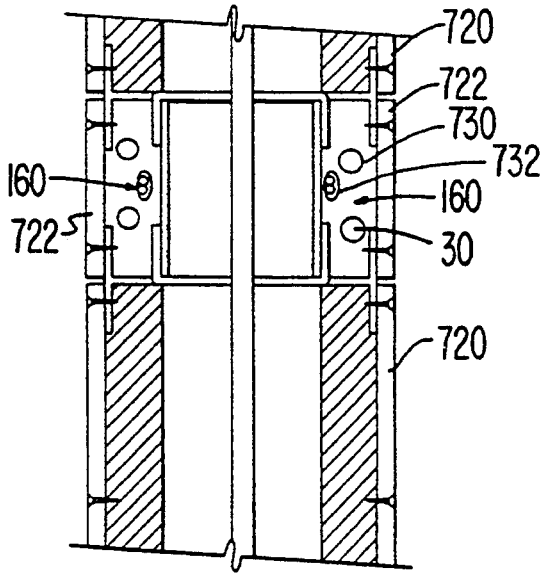
FIG. 43 is an enlarged cross-sectional view of a horizontal bond beam Channel, showing sheet rock and siding attached and showing wiring and plumbing installed.

FIG. 44 shows an alternate tie construction 160'. Tie 160' is a flat strap with slot 170' to guide and accommodate two Rebars. Tie 160' has an aperture 168' at each end, for insertion of screws. This allows the ties to be screwed into the Channel members. In that event, slots 132 and flaps 134 do not need to be formed into the Channel members.

Tie 160' has an elongated, straight slot 170', which is of a size to snugly guide and accommodate two Rebar diameters, shown in phantom.

The bond beam Channel members 120, and ties 160 and 160', can be made of many relatively inexpensive materials. In one preferred embodiment of the invention, the bond beam Channel members 120 are made of 20 gauge sheet metal and ties 160 or 160' are made of 12 gauge sheet metal stampings. In another preferred embodiment of the invention, the bond beam Channel members 120 and ties 160 and 160' are formed of extrusions of commercially available polyvinyl-chloride or other thermoplastic material. These materials are also used for the vertical bond beam and Pilaster Channel members and ties.

Although it is preferred to use separate ties to fasten the Channel members of the horizontal, vertical and Pilaster Channels, it is within the scope of this invention to form the ties and Channel members in a unitary structure, for example, in unitary injection molded sections. This would eliminate the labor in assembling the Channel members.

The horizontal bond beam Channel members 120 are created in standard 8-foot long lengths. They may be cut with a saw, to accommodate the particular internal or external wall dimensions of the building being constructed, and to form suitable openings for doors and windows.

Figures 6, 7, 8, 9:
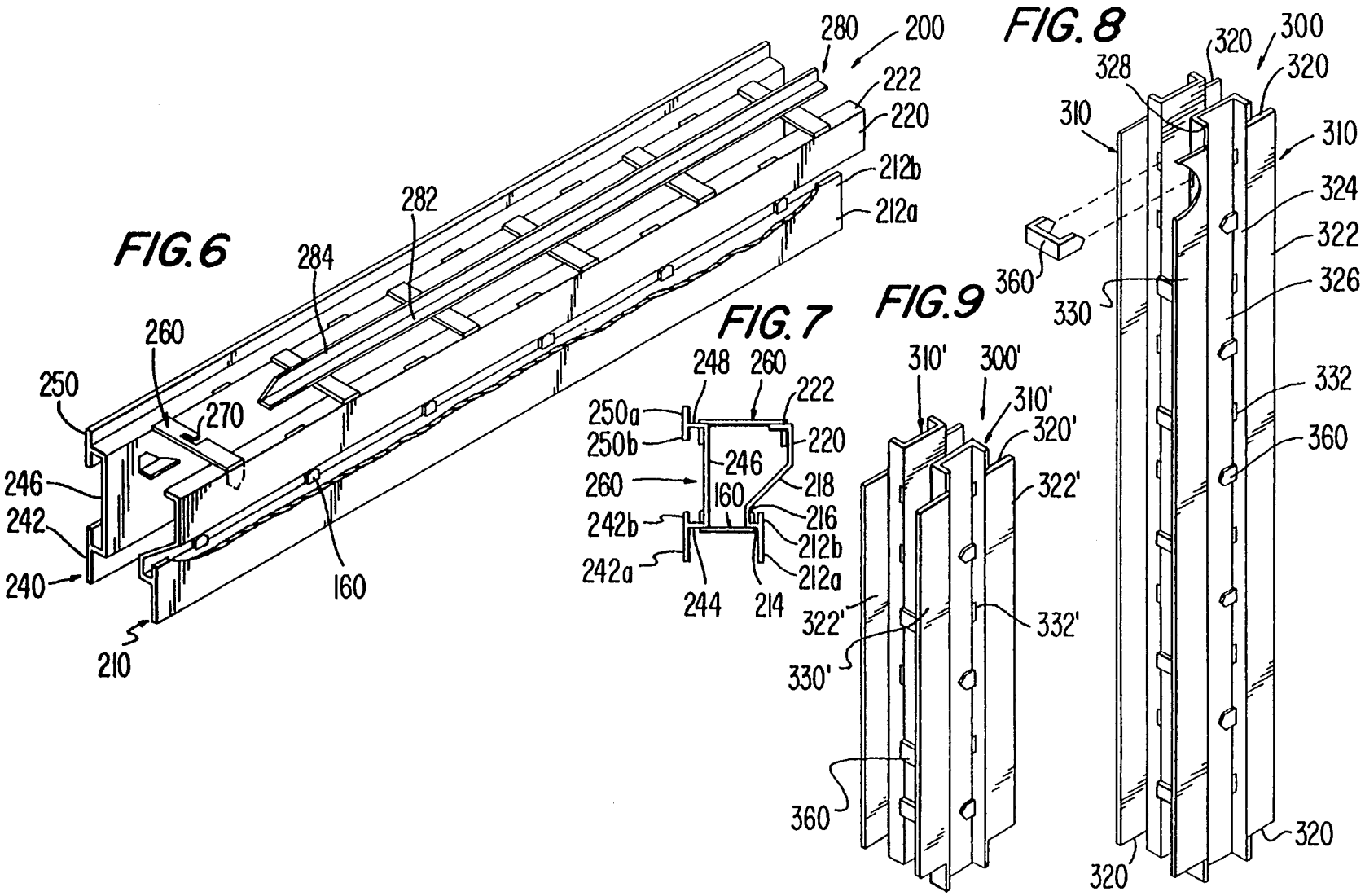
FIG. 6 is a perspective view, partly broken away, of a Pilaster Channel of this invention.
FIG. 7 is an end view of the Pilaster Channel of FIG. 6.
FIG. 8 is a perspective view of a one-story vertical bond beam Channel of this invention.
FIG. 9 is a view, similar to FIG. 8, of a half-story vertical bond beam Channel.

2. Pilaster Channels. The structure of the Pilaster Channels 200 is seen in FIGS. 6 and 7. Each Pilaster Channel constitutes five elements. They are:

a. Internal Pilaster Channel member 210;
b. External Pilaster Channel member 240;
c. Lower Pilaster tie members 160;
d. Upper Pilaster tie members 260; and
e. When a course of Blocks is to be added above the Pilaster, an angle-bar 280 is needed.

The Pilaster Channels are used wherever a floor or roof is to be supported. The Pilaster Channels serve two functions. They are the conduit through which concrete is introduced into the cylindrical apertures 52 and 62 in the Insulating Blocks and into bond beam Channels 100 and 300. They also act as support surfaces for the floor and roof Joists and Trusses.

External Pilaster channel member 240 is substantially identical to horizontal bond beam Channel member 120, except that the central section 246 is substantially higher, being twelve inches in height, rather than the six inches in height of member 120. In all other respects, these two Channel members are the same.

External Pilaster Channel member 240 is made up of upper and lower vertically extending flanges 242 and 250, horizontally extending webs 244 and 248 and vertical member 246. Along the upper and lower edges of vertical member 246 are spaced slots 232, which are normally closed by flaps 234 (not shown). The flaps 234 are like the flaps 134 and are displaced when the appropriate legs 262 and 264 of the ties 260 are inserted therethrough. Those slots 232 that do not have tie legs projecting therethrough are closed by the flaps 234. In this way, concrete leakage is prevented. Alternately, the need for slots and flaps can be avoided if the tie construction of FIG. 44 is used. The spacing between ties permits concrete to be poured into the Pilaster Channel. As seen in FIG. 6, the ties 260 and 160 are located in alternately staggered relationship to provide structural strength to the Channel, without needing as many ties as there are slots.

Internal Pilaster Channel member 210 has lower vertical flange 212 and horizontal web 214, which are of the same dimensions as the corresponding external Pilaster Channel members 242 and 244. However, the Pilaster Channel member 210 has a vertical web 216, an outwardly projecting wall member 218, with a vertically extending flange 220 and a horizontal flange 222. The spacing between flange 220 and web 246 of the two Pilaster Channel members is 14 inches.

The lower ends of the Pilaster Channel 200 are held in place by ties 160, which are identical in all respects to the ties that are used for horizontal bond beam Channels 120. Ties 260, which are used at the top of the Pilaster channel members, are in substantially all respects the same as ties 160, except that they are 14 inches long, to accommodate the spacing between elements 220 and 246. Slot 270, which is of the same shape and dimensions as slot 170 in tie 160, is located the same distance from the wall member 246 as is the slot 170, so that the slots 170 and 270 will guide and hold the Rebars passing therethrough in vertical alignment into the centers of the cylindrical apertures 52 or 62, as the case may be.

In forming the Pilasters, the upper ledge of the Pilaster is desirably at least about one-and-one-half times the width of the base of the Pilaster.

Angle-bar 280 is fastened by the attachment of leg 282 to the tie members 260, using suitable screws or rivets. The purpose of angle-bar 280 is to hold the next course of Insulating Blocks in place, sandwiched between flanges 250 and 284. Vertical flange 284 is substantially parallel to vertical flange 250 of the Pilaster channel member 240. At the roof Pilaster Channels, there is no next course of Blocks, so no angle-bar is needed there.

The Pilaster Channel members and ties are preferably all formed of the same material. In one preferred embodiment, they are all formed of stamped sheet metal. In another preferred embodiment, they are formed of extruded polyvinylchloride. The materials are preferably the same as the materials of the bond beam Channel members.

As with the horizontal bond beam Channel members, the Pilaster Channel members preferably come in eight-foot lengths, and may be cut, if desired, to accommodate any structural changes, as for doors, windows and shortened walls.

Figure 25:
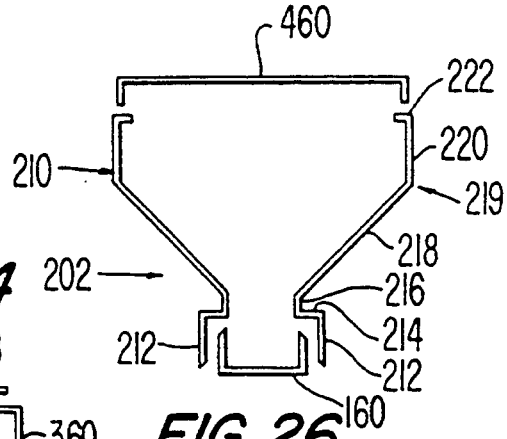
FIG. 25 is an end view, partly exploded, of a double Pilaster Channel.

It may be desired to create internal walls (between rooms), or porches, platforms and other external overhangs that require external support. In those instances, a double Pilaster Channel 202, as shown in FIG. 25, is utilized. The double Pilaster Channel 202 is identical to the single Pilaster Channel, except that it has two Pilaster Channel members 210, as illustrated, and requires twenty-two inch ties 460 with Rebar slots 270 in their geometric centers (not shown), to center the Rebars. Joists and Trusses may be secured to the double Pilasters, in the manner indicated for the single Pilasters, and utilized to support additional floors, porches, etc.

3. Vertical Bond Beam Channels

Figure 24:
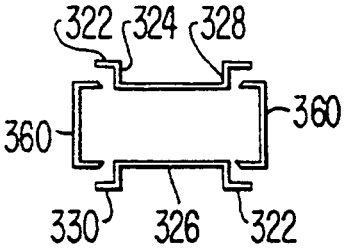
FIG. 24 is a top view, partly exploded, of a vertical bond beam Channel.

As best seen in FIGS. 8, 9 and 24, the vertical bond beam Channel 300 is composed of two opposed bond beam Channel members 320, secured by ties 360.

The vertical bond beam Channel members are of substantially the same shape and dimensions as horizontal bond beam channels 120, except that center web members 326 are preferably eight inches long, to create 5"×8" concrete bond beams. The vertical bond beam Channels may come in 8'6" lengths, as shown in FIG. 9, to occupy an entire story elevation of a structure. Preferably, however, they are constructed in four-foot lengths 320', as shown in FIG. 8, because the Insulating Blocks are only four feet high.

Figure 46:
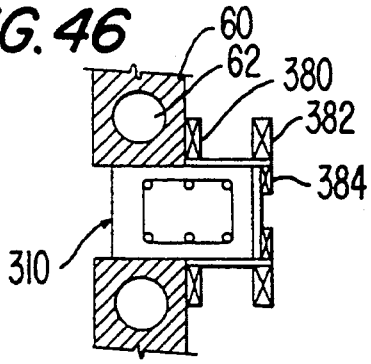
FIG. 46 is a cross-sectional view of a vertical bond beam Channel adapted to create a structural bearing column.

It may be desired to create a vertical bond beam, which is eight inches wide by up to twenty two inches deep, to provide additional structural support to a wall. This may occur when a large window wall is being created or when a girder is being incorporated into a building and needs a support member. In these instances the eight foot six inch bond beam members 320 will be used to create the bond beam Channel but, instead of five inch ties 360, longer ties 360' are used, as seen in FIG. 46. The length of the ties 360 and consequently the depth of the resulting bond beam will be varied according to Code requirements and the load to be carried by the bond beam. The open space created by these deeper vertical Channel members will be filled by nailing or screwing lumber in to fill the space, for example. This is illustrated on FIG. 46, where conventional Channel members 310 are used, with extra long ties 360'. The spaces caused by the extended Channel form are filled with pieces of dimensional lumber 380, 382 and 384, which are nailed or screwed to the Channel member 310.

If no plumbing is to be mounted at a location between Blocks and no electrical fixtures are to be located more than four feet from the floor, and if a vertical bond beam is not needed for structural support, only four feet of vertical bond beam will be created in that story. Where plumbing must go from floor to floor, wall mounted electrical fixtures are to be installed or structural support is needed, an eight foot six inch vertical bond beam Channel is created between two floors, using two four-foot sections and a splice or one eight-foot six inch member 320.

Figure 10:
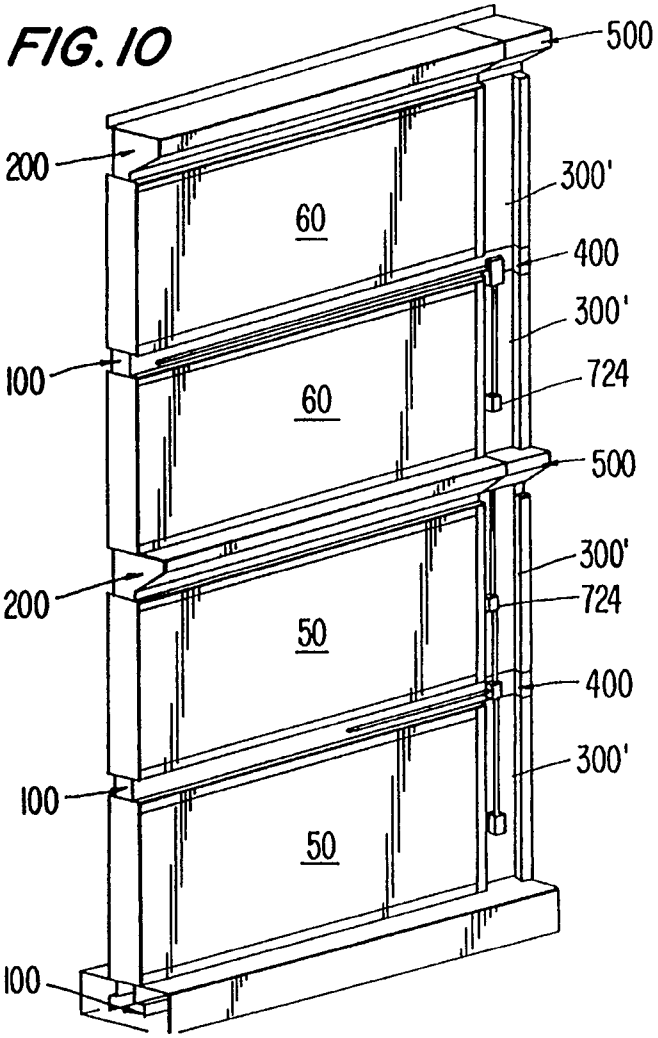
FIG. 10 is a perspective view of a section of a formed wall of this invention.

The Channel members 320 have 1½" cut-outs 310 at each end. These are needed to accommodate horizontal splice members 400 (see FIGS. 15 and 16) when intersecting vertical and horizontal bond beam Channels are connected, as seen in FIG. 10. The Channel members 320 are fastened by the insertion of ties 360 within overlapping slots 332 in the adjacent horizontal bond beam Channel members.

The vertical bond beam ties 360 are identical to the horizontal bond beam ties 160, except that the central portion 366 is solid.

The vertical bond beam Channels are constructed in the same way as the horizontal bond beam Channels, with the legs 362 and 364 of ties 360 being hammered into slots 332, in staggered relationship on opposite sides of the Channel members.

4. Caps and Splices

In order to cap the ends of the horizontal and vertical bond beam and Pilaster Channels, at the ends of wall sections or where window or door openings are created, and in order to splice intersections between horizontal and vertical bond beam Channels, respective cap and splice members are provided.

The Pilaster splice members 510 and 540 are the same size and cross-sectional shape as the Pilaster Channel members 210 and 240. The splice members are desirably about 24 inches in length, to securely bridge the eight-inch space across a vertical bond beam, as seen in FIG. 14 and be securely fastened at the ends to the Pilaster Channel members 210 and 240.

The Pilaster splice member 510 has notched ends 512 that extend eight inches into and overlap the Pilaster Channel members 210 on each side when inserted, and are interconnected by having ties 260 inserted through aligned slots 232 and 532 in the overlapping Pilaster member 210 and Pilaster splice member 510. Apertures 520 in the Pilaster splice member 510 are drilled, when needed, to permit a pipe to pass from one story of a building to the next.

Similarly, the Pilaster splice member 540 has eight-inch slotted ends 542 that extend into and overlap the end of the rear Pilaster member 240 and is interconnected by ties 260 extending into aligned slots 232 and 532.

Figures 14, 15, 16, 17, 18, 19, 20, 21:
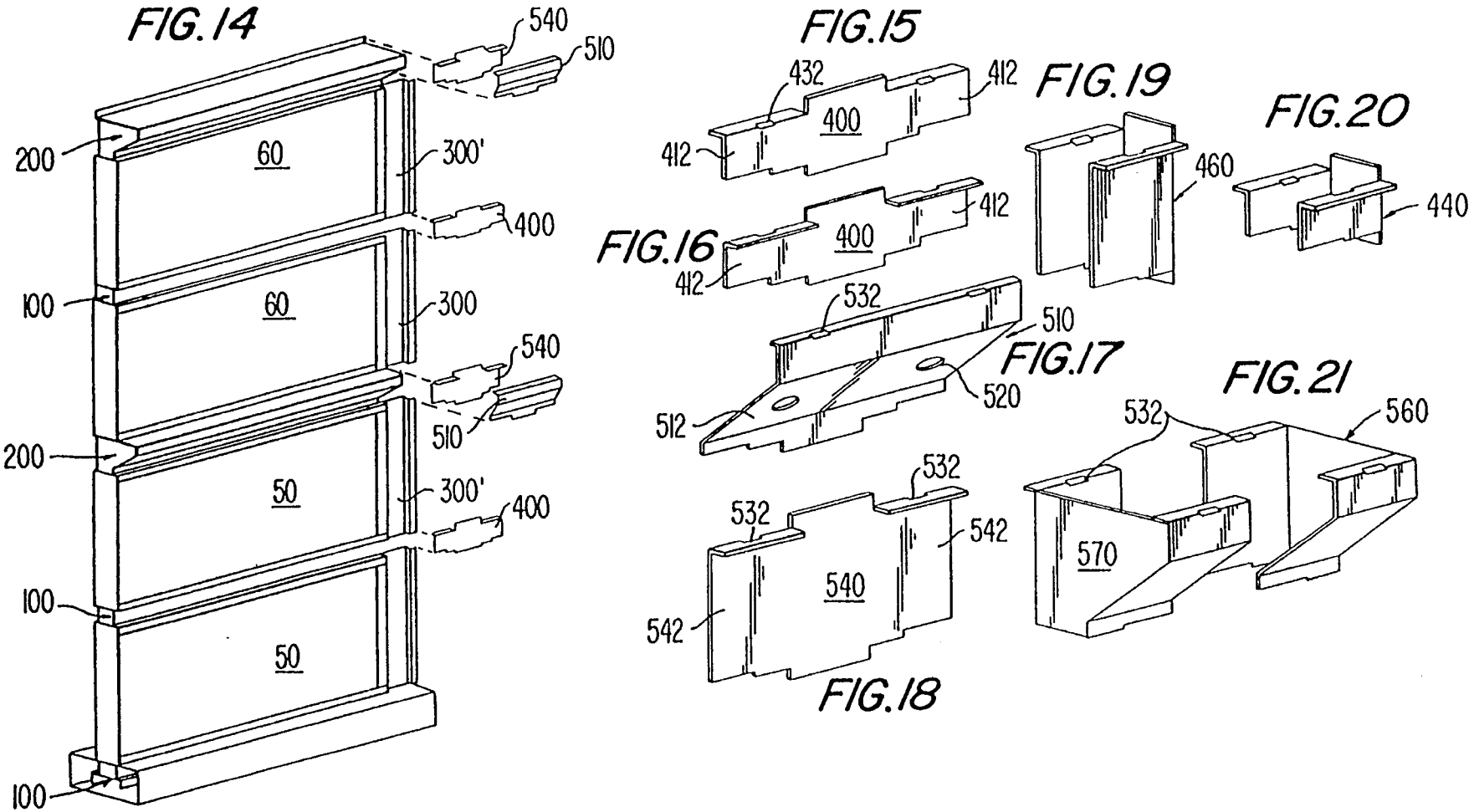
FIG. 14 is a perspective view, similar to FIG. 10, showing the Pilaster and horizontal bond beam splices exploded.
FIG. 15 is a perspective view of the rear of a horizontal bond beam splice of this invention.
FIG. 16 is a perspective view of the front face of the horizontal bond beam splice of FIG. 15.
FIG. 17 is a perspective view of a Pilaster beam splice, with two holes drilled in it to permit insertion of plumbing pipes or sleeves.
FIG. 18 is a perspective view of the rear Pilaster Channel splice.
FIG. 19 is a perspective of an end cap for sealing the end of the Pilaster Channel segment illustrated in FIG. 26.
FIG. 20 is a perspective view of an end cap for a horizontal bond beam Channel.
FIG. 21 is a perspective view of opposite Pilaster Channel end caps.
Figure 22:
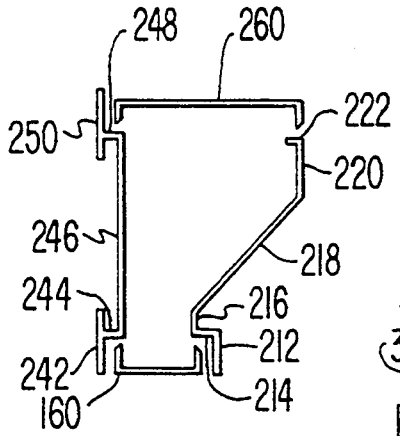
FIG. 22 is an end view, partly exploded, of a Pilaster Channel.

FIGS. 15 and 16 show the horizontal bond beam Channel splice member 400. The front and rear splice members 400 are the same, and have extended sections 412 which overlap the horizontal bond beam Channel members and are attached by ties 160 fastened into aligned slots 132 and 432. The horizontal bond beam splice members 400 are used at all intersections of Channels 100 with the vertical bond beam Channels 300'.

FIG. 21 shows Pilaster end caps 560 and 570, which are constructed to cap the left and right ends of each Pilaster Channel, and contain concrete flow. This is needed at the ends of each wall section. The end caps are connected by ties inserted into aligned slots 232 and 532 in the Pilaster Channel and end cap members.

Similarly, end caps 440 and 460 are provided to cap the respective six inch horizontal and double twelve inch vertical bond beams at the ends of each wall section. These are seen in FIGS. 20 and 19, respectively, and in FIGS. 41 and 40.

Figure 26:
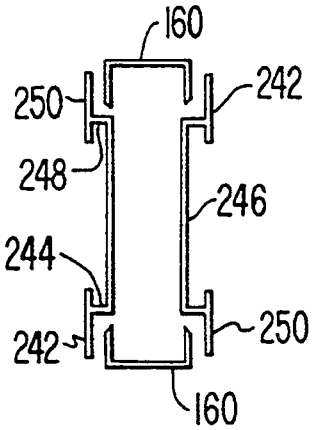
FIG. 26 is an end view, partly exploded, of a Pilaster beam end piece, used to form a corner, as seen in FIG. 40.
Figures 37, 38, 39, 40, 41:
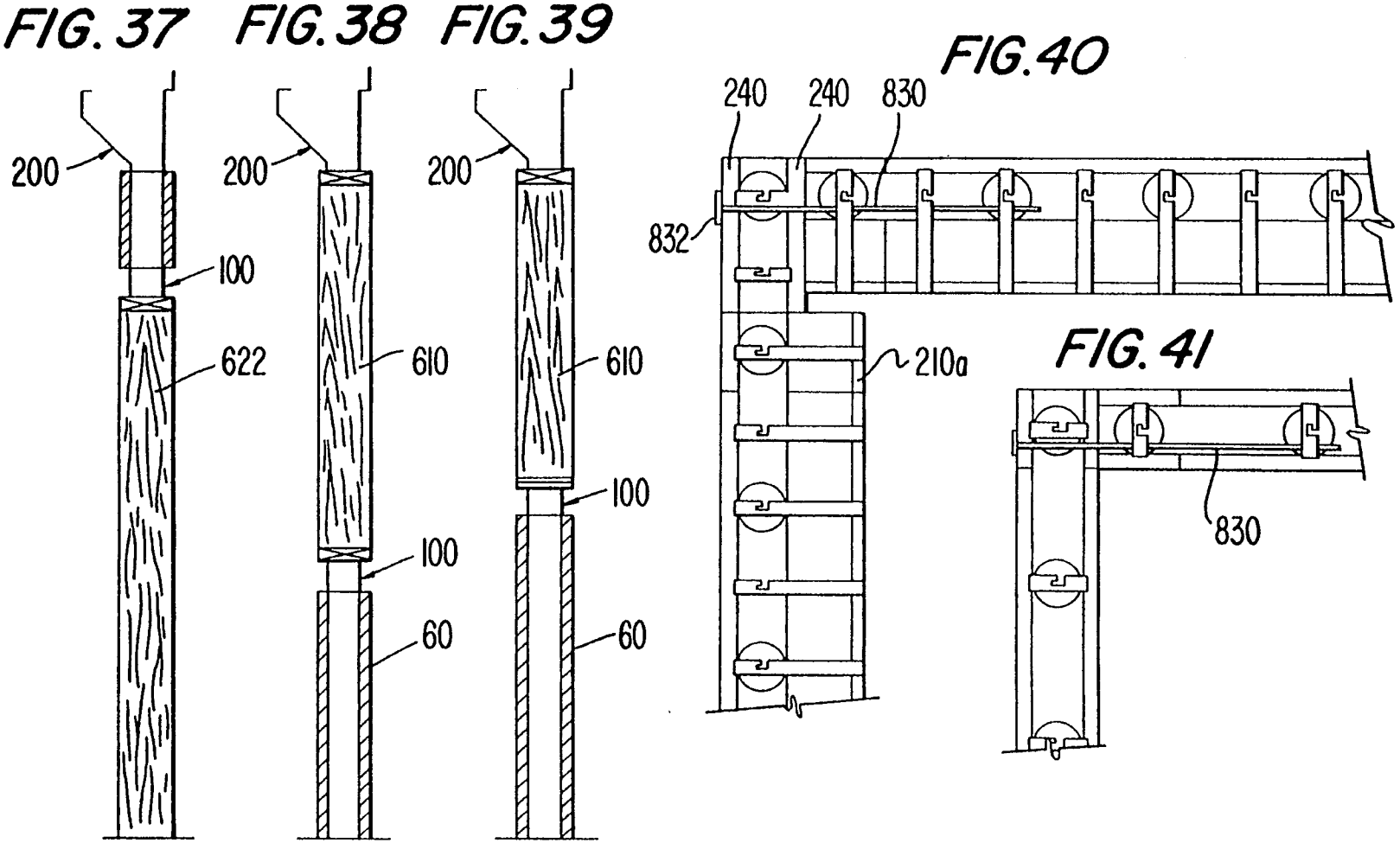
FIG. 37 is a partial cross-sectional view of a wall structure of this invention with a door insert.
FIG. 38 is a partial cross-sectional view of a wall structure of this invention with an elongated window insert.
FIG. 39 is a view, similar to FIG. 38, with a typical window insert.
FIG. 40 is a top plan view of a corner of the wall structure of this invention, at a Pilaster Channel, showing the connection of two abutting Pilaster Channels.
FIG. 41 is a view, similar to FIG. 40, at the intersection of two horizontal bond beam Channels forming a corner.
Figure 45:
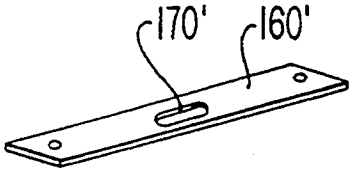
FIG. 45 is a view, similar to FIG. 44, without the Rebars.

As seen in FIG. 40, the right-angle intersection of two Pilaster Channels is handled by cutting off a two-foot section from one Pilaster Channel member 210*a* and replacing it with an equal length section from a rear Pilaster Channel member 240, thus creating a two-foot bond beam at the end of this wall, to accommodate the perpendicular Pilaster Channel. A cross-section of this Channel section is shown in FIG. 26.

The splices and end caps are constructed of the same material as the Channel members.

5. Wall Anchors

Figure 27:
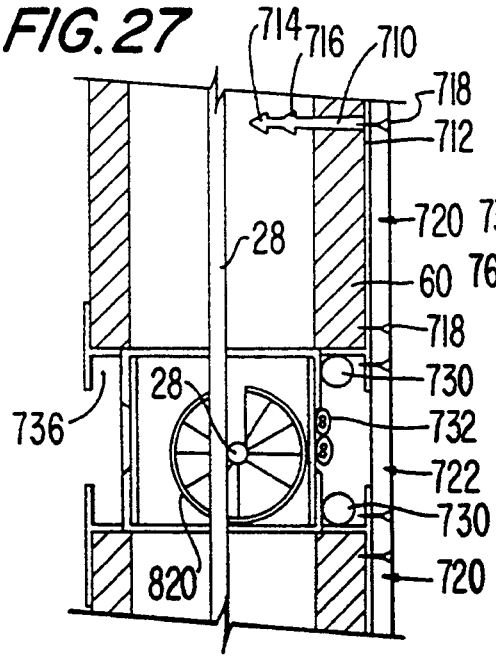
FIG. 27 is a fragmentary cross-section of the wall structure of the invention, looking into a vertical bond beam Channel, showing a recess with plumbing and electrical wiring inserted, and showing the placement of vertical and horizontal Rebars to meet Code.
Figure 28:
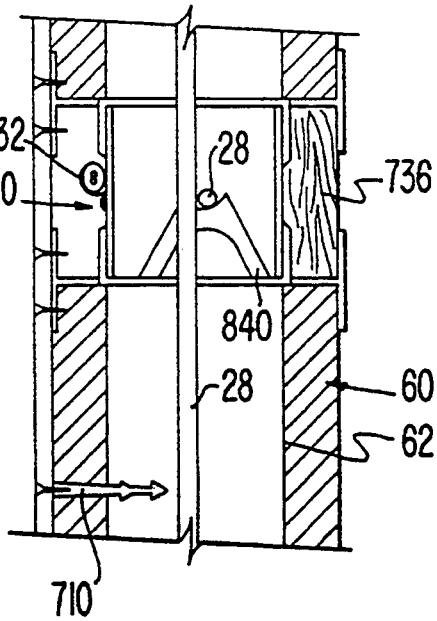
FIG. 28 is a view, similar to FIG. 27, showing a horizontal bond beam Channel in section, showing the placement of horizontal and vertical Rebars to meet Code, with electrical wiring inserted.

FIGS. 27 and 28 show standard commercial plastic anchors 710 inserted in Block 60. These plastic anchors 710 are conventionally used for anchoring thin foam sheets of insulating material to the earth, creating insulated floors. In their prior art commercial use, thin polystyrene foam sheeting is to be placed under a concrete floor slab; the sheet is placed on the ground and the anchor is pressed through the sheet and projects into the ground to hold the insulation sheeting in place prior to the concrete pour. When the concrete is poured, it sets above the sheeting.

Figure 29:
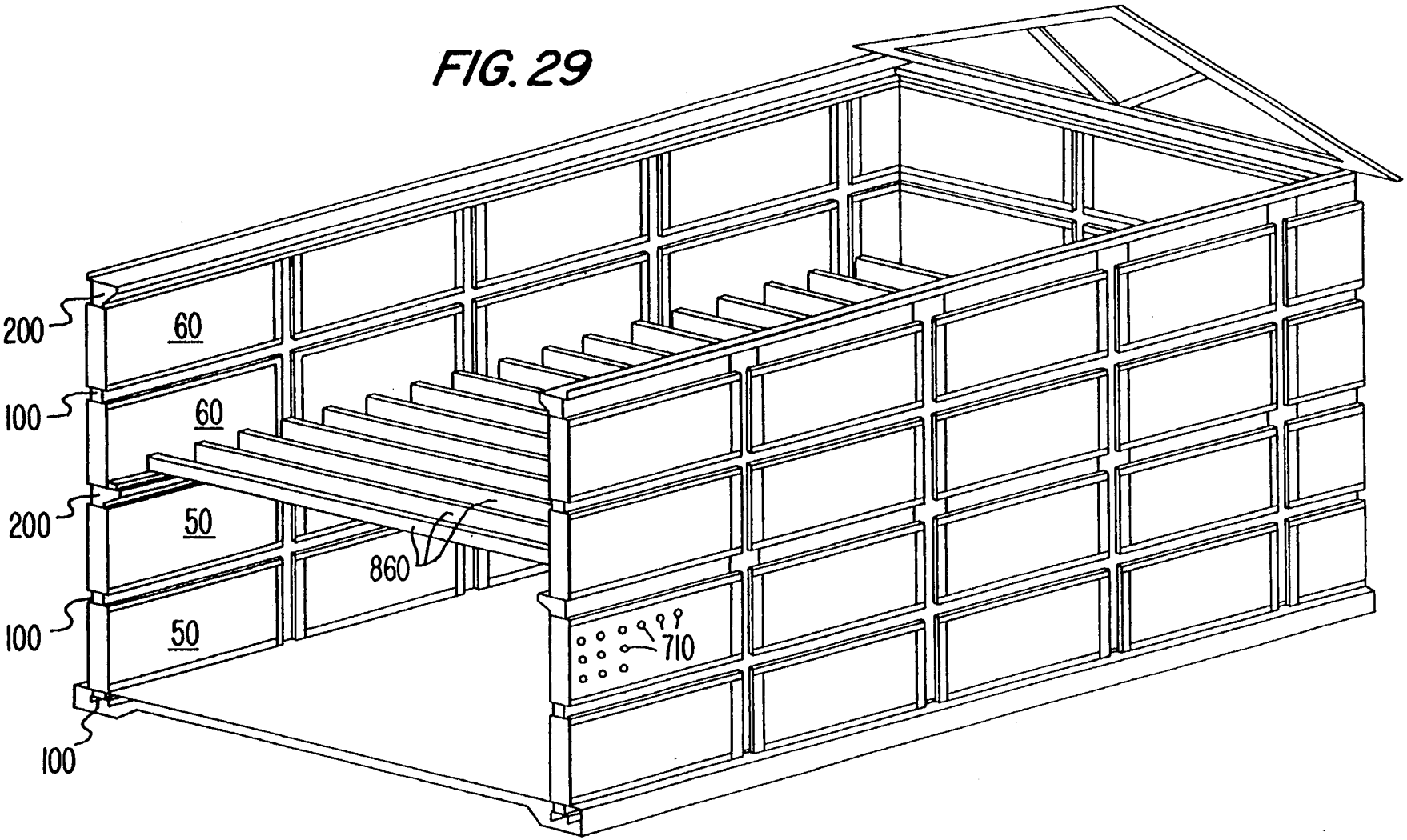
FIG. 29 is a perspective view of a partly assembled building in accordance with this invention, with floor and roof Trusses inserted.

In the practice of this invention, plastic anchors 710, which may be the commercially available plastic anchors illustrated or could be other sizes and shapes, are pressed through the walls of the Insulating Blocks 50 and 60 as needed, so that they project into the cylindrical apertures, respectively 52 and 62. Many anchors are located about the wall form, preferably on sixteen inch centers, as seen in FIG. 29. After concrete is poured and the cylindrical apertures are filled with concrete, the concrete sets, locking the anchors 710 into the concrete columns. The flat outer head 712 of the anchor sits on the external surface of the Insulating Block, and the toe 714 projects into aperture 52 or 62, as the case may be. The toe has barbs 716 to enhance engagement with the concrete. The anchor 710 is used as a receptacle for inserting screws or nails to secure sheet rock, siding or anything else that is desired to be hung from the wall structure of the invention, as seen in FIGS. 27 and 28. Plastic anchors usable in the invention are commercially available from Aztec Concrete Accessories, Inc. of Orange, Calif.

6. Rebars

The Rebars used in the practice of the invention are preferably standard, commercially available steel bars. They come in standard twenty foot lengths, but can be ordered in any desired length at little or no additional cost. In order to meet Code, each length of a Rebar splice (an overlap of two Rebars) must be at least forty times the diameter of the Rebar. Thus, if a one-half-inch diameter Rebar is used, the Rebar splice length must be at least twenty inches. Code permits the splicing of Rebars, provided that there is at least forty bar diameters of overlap and that the two Rebars that overlap are contiguous.

In order to accommodate easy handling of the Rebars in the invention and to meet Code, Rebar members may be overlapped and connected, using standard, commercially available extension clips 752, as seen in FIG. 31. In the cylindrical apertures 52 and 62, the splices are held in place by ties 160 or 260, as applicable.

Where vertical and horizontal Rebars cross, it is not necessary for them to be connected to each other, to meet Code requirements, but it is desirable to use cross clips 750, as seen in FIG. 31, to hold the Rebars in proper position prior to concrete pour. Cross clips are also commercially available.

Horizontal and vertical Rebar members are properly positioned to meet Code Requirements, by the use of spacer wheels 820 in the vertical Channel members and cradles 840 in the horizontal Channel members, as seen in FIGS. 27 and 28.

Different diameters of Rebars may be utilized. The standard Rebar diameters are one-half inch, three-quarters inch and one inch. The diameter selected will depend upon the size of the building being constructed and its structural requirements. The size of tie slots 170 and 270 are selected to snugly engage the Rebars being used in the structure.

7. Insulating Blocks

In the preferred embodiment of the invention, the Insulating Blocks 50 and 60 are standard, commercially available bead polystyrene foam blocks. They are commercially sold in blocks that are eight feet long, four feet high and eight inches deep. The Blocks are sold having different "R" values, providing different degrees of insulation. A preferred Block, for the practice of the invention, would have an R value in the range from about 25 to about 32, to provide good insulation from heat and cold.

The polystyrene material from which the Insulating Blocks are made does not form a part of the invention. Commercially available Blocks are manufactured and may be purchased from Insulation Corporation of America, for example. Although bead polystyrene foam blocks are preferred, because of their relatively low cost, ease of handling and good insulation value, it is within the purview of this invention to use other polymer foams and other insulation materials as well. For example, polyurethane foam Blocks are available and may be used.

Referring to FIGS. 4 and 5, the Insulating Blocks are provided with 5-inch diameter holes, desirably located on 8-inch (holes 52) or 16-inch (holes 62) centers, or any multiple of 8-inch centers. The Blocks 50 in the basement of any structure will desirably have cylindrical apertures 52 located on 8-inch centers, for greater structural strength. Blocks 60 above the ground level will have apertures 62 on 16-inch centers, because not as much structural strength is needed. Eight-inch multiple spacing of columns is desired because Codes are usually based on multiples of eight-inch spacing between studs.

The cylindrical apertures 52 and 62 in the Blocks may be created using molding techniques in the formation of the Blocks, using commercially available drills, or using heated wire core cutters, in manners which are well known in the art.

8. Window and Door Inserts

Figure 12:
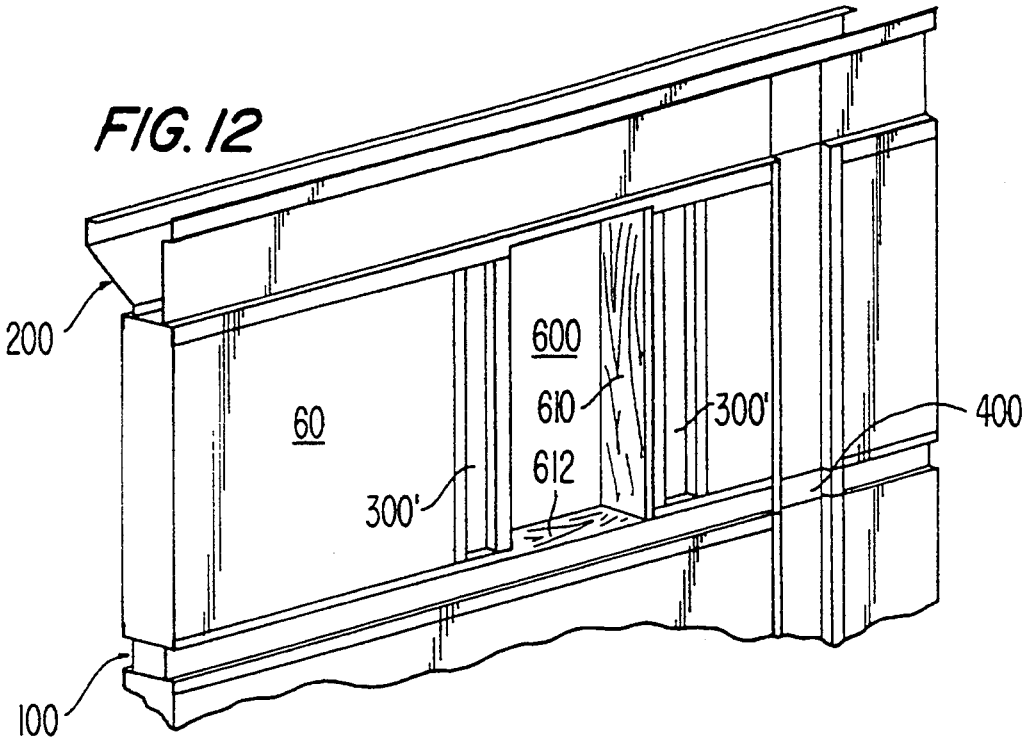
FIG. 12 is a fragmentary perspective view of a wall, in accordance with this invention, having a window aperture.

As discussed below, apertures are formed by the Insulating Blocks and the bond beam Channel members to permit the insertion of preferably prefabricated, standard-sized door and window assemblies. This is seen in FIGS. 12, 38 and 39 for windows and FIGS. 13 and 37 for doors. The construction of such door and window assemblies is well known in the art and does not form part of this invention.

As seen in FIG. 12, a window aperture 600 is formed by cutting Insulating Blocks and inserting vertical bond beam Channels 300' to define a suitable opening, adapted to receive a window frame. The four sides of the opening are closed and sealed by 2"×8" boards 610 and 612 nailed or otherwise fastened into the Channel members which define the opening. After concrete is poured and set, a window unit (not shown) is inserted and nailed or otherwise fastened to boards 610 and 612.

Figure 13:
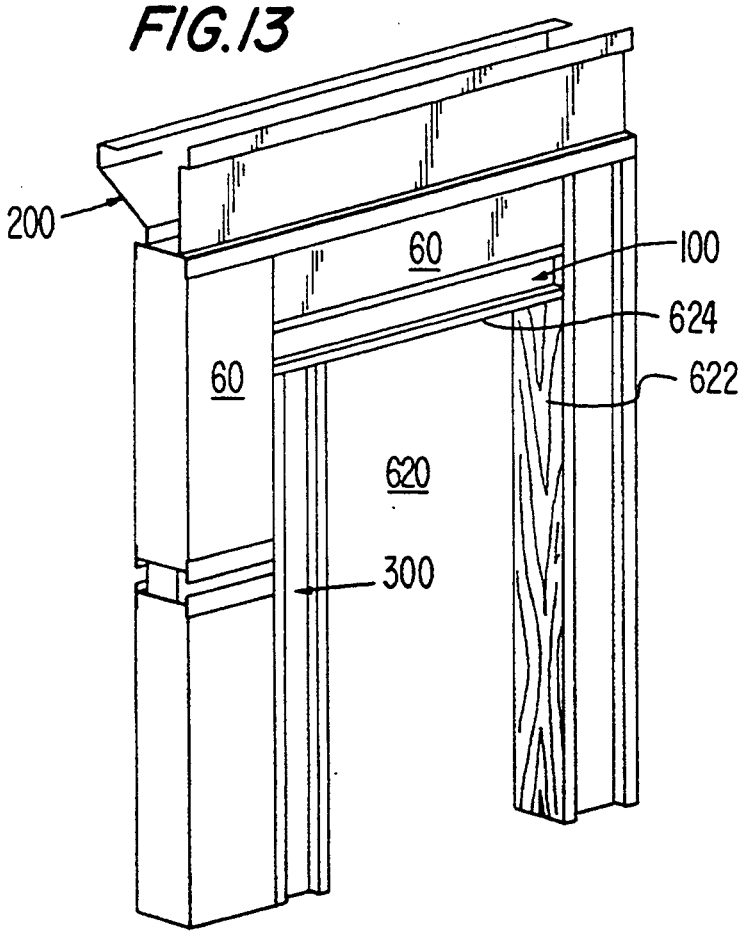
FIG. 13 is a perspective fragmentary view of a wall with a door aperture in accordance with this invention.

As seen in FIG. 13, a door aperture is formed by cutting Insulating Blocks 60 and horizontal Channel members 100 and inserting a suitable framework of horizontal Channel members 100 and vertical Channel members 300, sealed by 2"×8" boards 622 and 624, which are fastened to the Channel members. The door unit (not shown) is later fastened to the boards 610 and 612.

Since one of the purposes of this invention is to provide low-cost housing, it is desirable to use standard, readily available window and door units. The window and door units are preferably prefabricated and set in frames. The frames are simply set in the apertures, created in the walls of the invention, for the windows and doors, are nailed or otherwise fastened into the wooden frame members, suitably caulked, and are then easily functional.

It is within the scope of this invention to utilize custom-made windows and doors, and therefore the standard sizes are not essential. However, where controlling cost is a desirable consideration, standard-sized, prefabricated windows and doors are also desirable.

9. Concrete

Various concrete mixes may be utilized within the spirit and scope of the invention, and the invention is not limited to any particular concrete mixes. In view of the fact that it is desired to be able to pour an entire structure in a Substantially Continuous Pour, and it is necessary to get adequate concrete flow to fill all horizontal Channels, vertical Channels and cylindrical apertures, plasticity or flowability of the concrete is important. Various concrete plasticizers are commercially available. They are added to the concrete when it is mixed, but before it is poured, and provide greater flowability of the concrete. The plasticizer may also accelerate or decelerate the amount of cure time required before the concrete is fully cured.

One plasticizer which may be utilized in this invention is "Rheobuild 1000", available from Master Builders, Inc. of Cleveland, Ohio. The plasticizer is added to give the concrete mix sufficient flowability to assure that, when introduced in the Pilaster Channels, concrete will adequately flow from the Pilaster Channels 200 through the cylindrical apertures 52 and 62 in the Blocks 50 and 60 and into the horizontal and vertical bond beam Channels 100 and 300 or 300'. The quantity of plasticizer added is dependent on the degree of flowability and set time desired for the concrete. The more plasticizer added, the easier the concrete will flow and the longer it will take to set.

The particular concrete mix selected will depend upon the size of the building, and the physical properties desired in the building, and are well within the purview of the skilled artisan in the field. A good example of a desirable concrete mix for constructing a 2-story, 1,600-square-foot residence is 3,000 p.s.i. concrete with ⅜" crushed stone aggregate.

The cure time of the concrete may be significant, because the time in which the concrete is substantially set, so that other construction activities on the structure may commence, may be as little as three days. Once the walls of one building have been poured, the building can be left for about three days, to allow the concrete to set fully. During this time, the construction teams may work on other buildings in the area.

10. Priming or Galvanizing. All metal used in the construction of the invention must be primed or galvanized if it is to come into contact with concrete, as required by Code. This is well known in the art.

The Structure

1. Foundation or Slab. Depending upon the particular kind of building being constructed, the base of the building will either be a dug foundation (basement), or a poured concrete footing located just below the frost line. In either event, the relevant aspects of the invention are the same. For example, viewing FIG. 1, an excavated footing 30 is illustrated. The bottom of the footing 32 is excavated to the frost line. The sides 34 of the footing may, for example, be three feet deep. Before any concrete is poured, adjustable screed chairs 36 and foundation chairs 38 are suitably placed along the bottom of the footing. The foundation chairs support and properly locate the horizontal reinforcing bars 40, which are set into the concrete of the footing. The adjustable screed chairs 36 support and level the horizontal bond beam Channels 100, by engaging ties 160, so the wall structure is level.

Screed chairs 36 are standard commercial items. They are desirable because they are adjustable up to two inches to adapt for variations in the level of the floor of the foundation, so that the horizontal bond beam Channel 100 may be leveled.

Foundation chairs 38 are also commercially available, but are not adjustable. The horizontal reinforcing bars 40, when required by Code, are placed across the floor of the footing, sitting on the foundation chairs 38. At least three inches from the edges of the foundation, L-shaped reinforcing bars or dowels 42 are locked into ties 160 of horizontal bond beam Channel 100, supported by and crossing the horizontal reinforcing bars 40. The L-shaped dowels are first assembled into the horizontal bond beam Channels 100 and then the entire Channel assembly is lowered into the footing, placed on top of the screed chairs 36 and leveled.

Sets of horizontal bond beam Channels 100 are placed peripherally about and within the foundation upon the screed chairs 36. The screed chairs 36 engage ties 160 of the horizontal bond beam Channels. The opposing Channel members 120 of each horizontal bond beam Channel are fastened, utilizing the ties 160. The vertical portions of each reinforcing bar 44 extend through the L-shaped slots 170 of the ties 160, and are held in place in the slots.

Since each horizontal bond beam Channel member 120 is eight feet long, the foundation will typically be formed of three or more horizontal bond beam Channels per side. Adjacent horizontal bond beam Channels are joined by splices 400, which are held to the horizontal bond beam Channels by ties 160.

Figure 30:
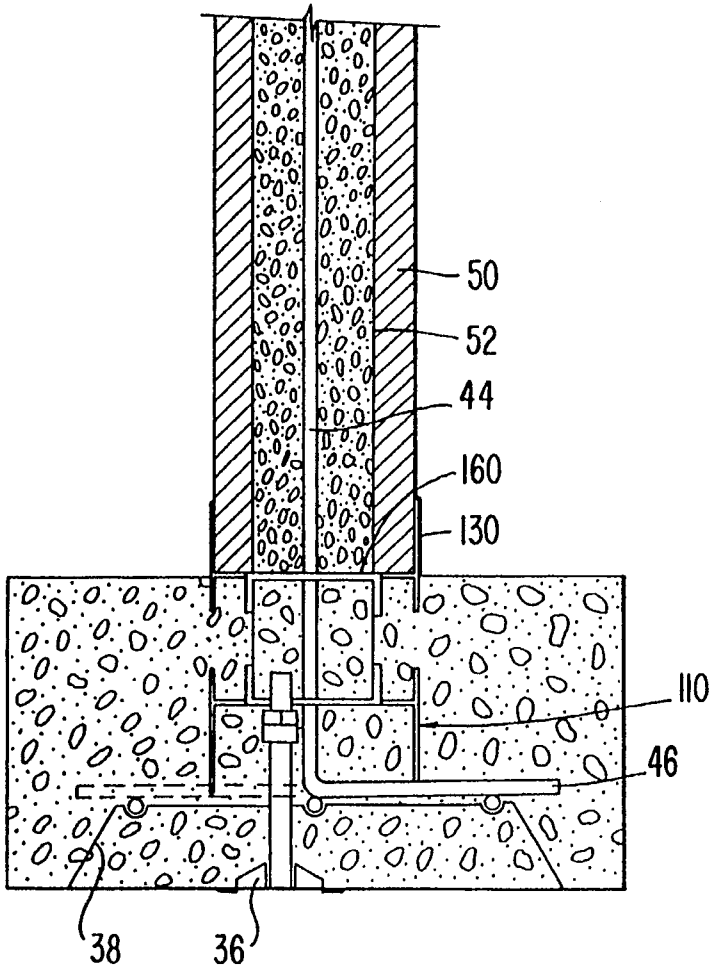
FIG. 30 is a partial cross-sectional view through a footing, showing the footing with a horizontal bond beam and Insulating Block inserted, after concrete is poured.

As seen in FIG. 1, once one set of reinforcing bars 44 and horizontal bond beam Channels 100, have been placed around the periphery of the foundation, connected and leveled, and also within the foundation in the locations in which interior walls will be created, the foundation is filled with concrete to the upper set of horizontal bond beam Channel flanges 124 and 128. When the concrete sets, the vertical flanges 122 and 130 of the bond beam Channel members will project above the concrete and snugly engage the Insulating Blocks 50, which are subsequently inserted. This placement is illustrated in FIG. 30.

Figure 35:
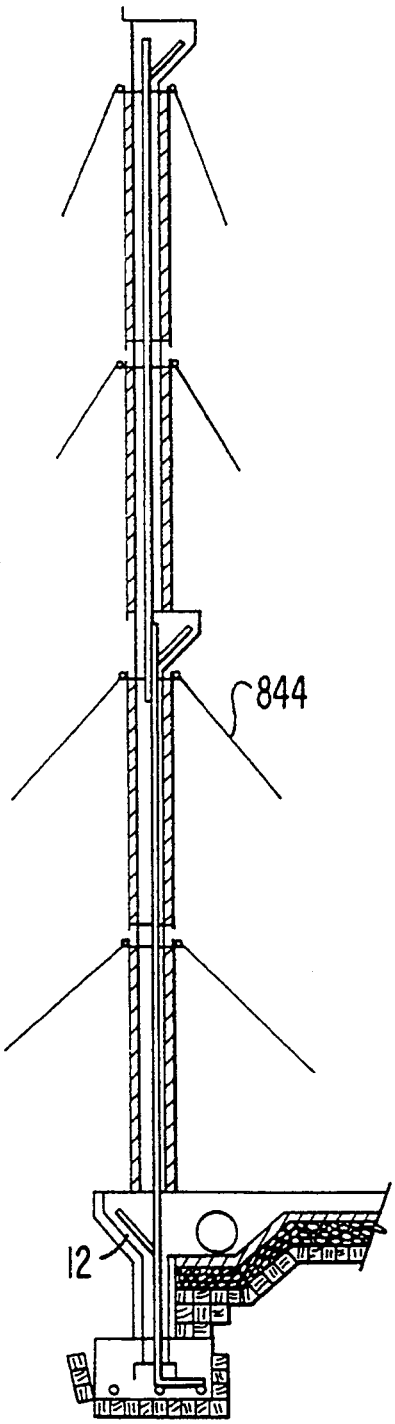
FIG. 35 is a partial vertical cross-sectional view of a two-story slab-on-grade structure with Pilaster frost wall serving as a brick shelf, and guy lines attached.
Figure 36:
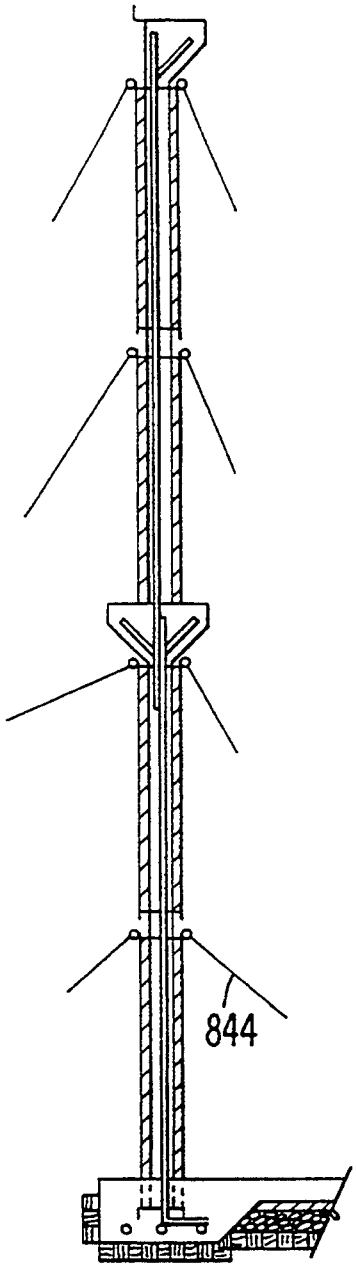
FIG. 36 is a view, similar to FIG. 34, in cross-section, showing a raised ranch with basement structure, having a double Pilaster configuration capable of supporting a floor and exterior deck, with guy lines attached.

If a basement is being constructed, once the concrete sets, the subsequent course of Blocks and bond beams are then assembled to the full height of the structure, as illustrated in FIG. 36. If a slab is to be poured, the first course of Blocks is adjusted so that when a horizontal bond beam Channel is set upon them, it serves as the form to pour and level the slab. FIG. 35 illustrates a foundation wall with a Pilaster bond beam serving in this instance as a brick shelf for decorative purposes. The subsequent courses of Blocks and bond beams can then be erected to full height, once the slab sets and sufficiently cures.

2. The Insulating Blocks

The first course of Insulating Blocks 50 or 60, as the case may be, is then inserted into the space formed by the horizontal bond beam Channel flanges 122 and 130. The cylindrical apertures 52 or 62, as the case may be, are placed over the vertical Rebars dowels 44. The spacing between each opposing pair of vertical flanges 122 and 130, in the preferred embodiment of the invention, is eight inches, to snugly accommodate and support the eight-inch width of each of the Insulating Blocks. Since the standard length of Insulating Blocks is eight feet, a single Insulating Block 50 or 60 will normally occupy a single horizontal bond beam Channel 100. However, the Insulating Blocks 50 and 60 and bond beam Channels 100 may be cut to accommodate variations in the length and width of the building and its interior and exterior walls, and also to provide spacing for windows and doors.

The vertical portions 44 of reinforcing bars 42 are desirably sized to project forty bar diameters above the foundation and provide the required splice when the vertical Rebars are later inserted in the apertures 52 and 62. This insertion preferably occurs after the entire wall structure is erected and stabilized, when the reinforcing bars 20 are "threaded through" the cylindrical apertures 52 and 62 in the Insulating Blocks, they are guided, held in place and centered by tie slots 170 and 270. The Rebar dowels 42 only need to project the required splice length above either the basement or foundation footing. When constructing a basement, however, the basement level vertical Rebar must be inserted in the Blocks 50 before erecting any subsequent courses of Blocks and bond beam Channels, if Blocks 50 will be followed by Block 60, because of the different on-center spacings of these two Blocks.

Figure 11:
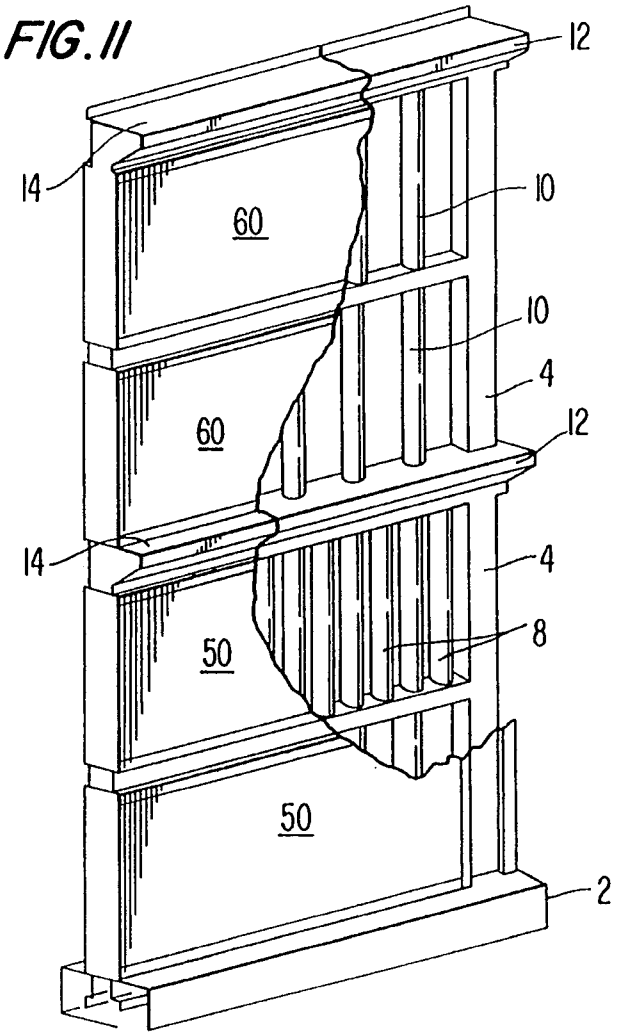
FIG. 11 is a view, similar to FIG. 10, with the Insulating Blocks and Channel members partly removed.

The first courses of Insulating Blocks in a basement wall have cylindrical apertures 52, which are located on eight-inch centers. All courses above ground level preferably have cylindrical apertures 62, located on sixteen-inch centers. The eight-inch centers in the first courses are to provide additional concrete cylinders 8 in all below-ground level Insulating Blocks, as seen in FIG. 11, to withstand the hydronic and hydraulic forces.

Each cylindrical aperture 52 or 62 in the Insulating Blocks preferably has a five-inch diameter, when used for an external wall. When filled with concrete, the concrete columns 8 or 10 have five-inch diameters. Internal wall apertures (not shown) are preferably three inches in diameter, since less structural strength is needed in these walls. Each concrete column 8 and 10, when centrally occupied by one or more suitably sized and located reinforcing bars, is superior to the wood studs of a building, and will exceed Code requirements.

The insulating capability of the below-ground Insulating Blocks, with five-inch diameter holes on eight-inch centers, is about R25. The same foam blocks, with five-inch diameter holes drilled on sixteen-inch centers, will have approximately an R32 insulating value.

3. Each Story.

When four-foot by eight-foot Insulating Blocks are used, two courses of Insulating Blocks, with a six-inch high horizontal bond beam between them, will create a distance between stories of eight feet, six inches, not counting the Pilasters. Thus, in the embodiment illustrated, two courses of Insulating Block with a horizontal bond beam Channel between them and a Pilaster at the top will be used in creating each story of the structure.

As seen in FIGS. 10, 29 and 35, two courses of Insulating Blocks with a horizontal bond beam Channel between them, and a Pilaster Channel at the top of the second course will create the form for each story of a building.

A typical building constructed in accordance with this invention will have one or two floors, and may have a basement. The forms for each additional story will be desirably created as set out above for the basement and first floor.

As seen in FIGS. 12 and 13, suitable cut-outs 600 and 620 are formed within the walls defined by the horizontal and vertical bond beam Channels, to accommodate windows and doors. The apertures in the wall structure created for the windows and doors are preferably closed by two by eight-inch wooden boards, nailed or screwed into the respective horizontal and vertical bond beam Channels defining the apertures. These wooden boards serve two purposes. First, they close off and seal the bond beam Channels which define the apertures, to prevent flow of concrete. Second, they provide a structure into which suitable window or door assemblies may be inserted and subsequently nailed or otherwise fastened. The apertures are created and sealed off before concrete is poured. The window and door units are preferably installed after the concrete has been poured and set.

As seen in FIGS. 10 and 11, the wall structure of this invention is comprised of two courses of Blocks per story. After the concrete is poured, each story of a building comprises two superimposed courses of Insulating Blocks 50 or 60, containing concrete cylinders 8 or 10, as the case may be, separated by concrete horizontal bond beams 6 and capped by concrete horizontal Pilasters 12. The Pilasters are located at the level of each floor or the roof.

Figure 23:
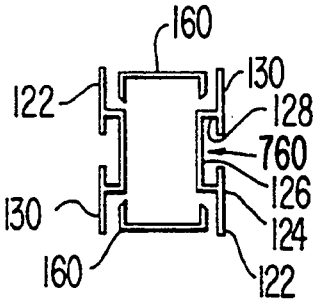
FIG. 23 is an end view, partly exploded, of a horizontal bond beam Channel.

Four-foot vertical bond beams may be located anywhere between horizontal and Pilaster beams to form windows or between each horizontally spaced pair or every other pair of Insulating Blocks to locate wiring and plumbing. The apertures in Blocks 50 and 60, when filled with concrete, create concrete cylinders, respectively 8 and 10, which interconnect the Pilaster and horizontal bond beam. Structurally interconnecting the concrete columns and beams are horizontal and vertical Rebars (not seen in FIG. 11) which abut each other at their intersections, as seen in FIGS. 27 and 28. The dimensions of the bond beam Channels are designed so that the horizontal and vertical bond beams are recessed, preferably on both the inner and the outer surfaces of the wall, at least one-and-one-half inches from the respective inner and outer surfaces of the Insulating Blocks. These recesses provide a 1½" deep channel 760, as see in FIGS. 23, 27 and 28. This recess 760 is sufficient to accommodate plumbing pipes, junction boxes and electrical wiring.

4. Electrical Junction Boxes, Pipes and Wiring

As seen in FIG. 10, the electrical junction boxes 724 are fastened into the concrete of the vertical bond beams, in the recesses 760 created by the difference in thickness between the bond beams and the Blocks. The junction boxes 724 are screwed or nailed into the vertical bond beam Channel members 120 before the concrete is poured, with the screws or nails extending about two inches into the bond-beam defining centers of the Channels. The poured concrete surrounds the ends of the screws (or other fastening means), so that once the concrete is set, the junction boxes are securely locked into the concrete.

Similarly, as seen in FIG. 27, the plumbing conduit 730 and electrical wiring 732 is fastened before the concrete is poured, by the use of suitable plastic yokes, or harnesses, that are screwed or otherwise fastened into the bond beam Channel members. Again, once the concrete is poured and sets, it surrounds the inwardly extending portions of the screws or other fastening means, so that they are permanently locked into the bond beam. If desired, the fastening means could be releasable at their exposed ends, so that if it is later desired to replace the plumbing or wiring, the exposed ends of the yokes can be released and the plumbing or wiring replaced.

5. Wall Anchors

As seen in FIG. 29, a multiplicity of plastic anchors 710 are fastened throughout the wall structure, on the inside and outside of each wall. Although the spacing may vary considerably, in a preferred embodiment of the invention, the plastic anchors 710 are secured in the vertical columns, spaced sixteen inches on center, horizontally and vertically.

As seen in FIG. 27, the plastic anchors 710 have sharp points or toes 714 and heads 712 and are shaped like large nails with barbs 716. They are pressed through the Insulating Block material, which is relatively soft, so that they extend at least two inches into the empty cylindrical apertures 62. When the concrete is subsequently poured into the apertures 62 (or 52, as the case may be), the cured concrete locks the anchors 710 in place.

There are preferably anchors on both the interior and exterior surfaces of each wall. The internal anchors support the sheet rock or wallboard, which is preferably also adhesively secured to the Blocks, for additional security. The external anchors are for the purpose of supporting vinyl or other siding. Suitable screws are fastened into the plastic material of the anchor, as seen in FIGS. 27 and 28.

Viewing FIGS. 27 and 28, the recesses 160 that are formed at the bond beams are seen to seat plumbing pipes 730 (FIGS. 27) and electrical wiring 732. The wiring 732 is fastened to harnesses or yokes. In both FIGS. 27 and 28, the outer recess 160 (at the exterior of the building) holds no pipe or wiring, and so it is filled with a strip of insulation 736, which is slid from the end of each Channel member and seated within the lips **122*b* and 130*b* of Channel member 120**.

When sheet rock is fastened to the interior surface of the Blocks, the Blocks are covered with an adhesive (not shown) and the sheet rock panels 720 are applied and screwed into the flanges **122*a* and 130*a* of the Channel members 120 and into the plastic anchors 710, as seen in FIGS. 27 and 28**.

As seen in FIGS. 27 and 28, the large pieces of sheet rock 720 terminate at the recesses and eight or six inch wide sheet rock strips 722 are screwed to flanges 330 and 322 of Channel members 310 and flanges **122*b* and 130*b* of the Channel member 110. Thus, these strips 722** may be removed when access is needed to the plumbing or wiring without damaging adjoining pieces.

6. Cylindrical Columns

Figure 34:
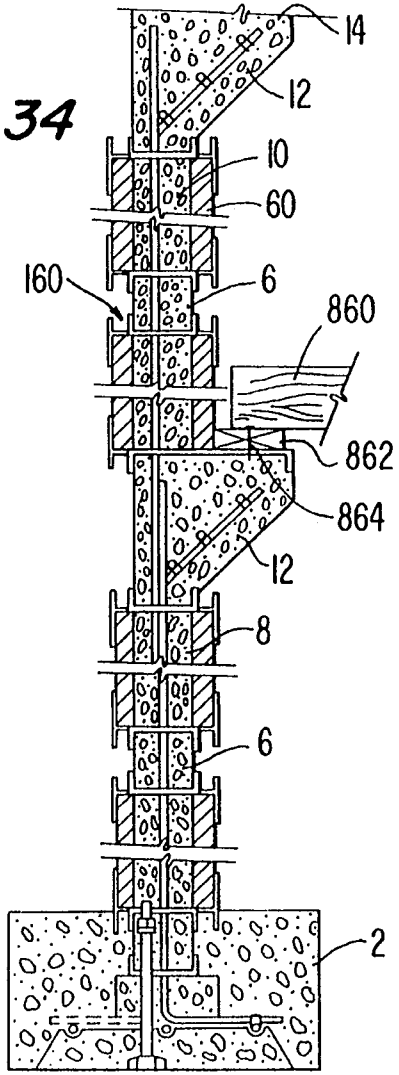
FIG. 34 is a fragmentary vertical cross-sectional view of a wall structure, after concrete has been poured and set, showing a footing and two stories, with an anchor plate inserted and Truss attached.
Figure 33:
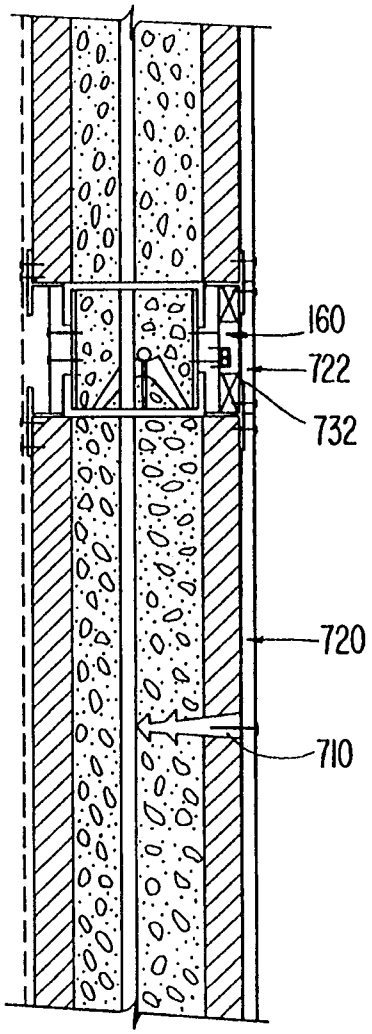
FIG. 33 is a fragmentary view, similar to FIG. 32, showing the mounting of sheet rock on the wall.
Figure 32:
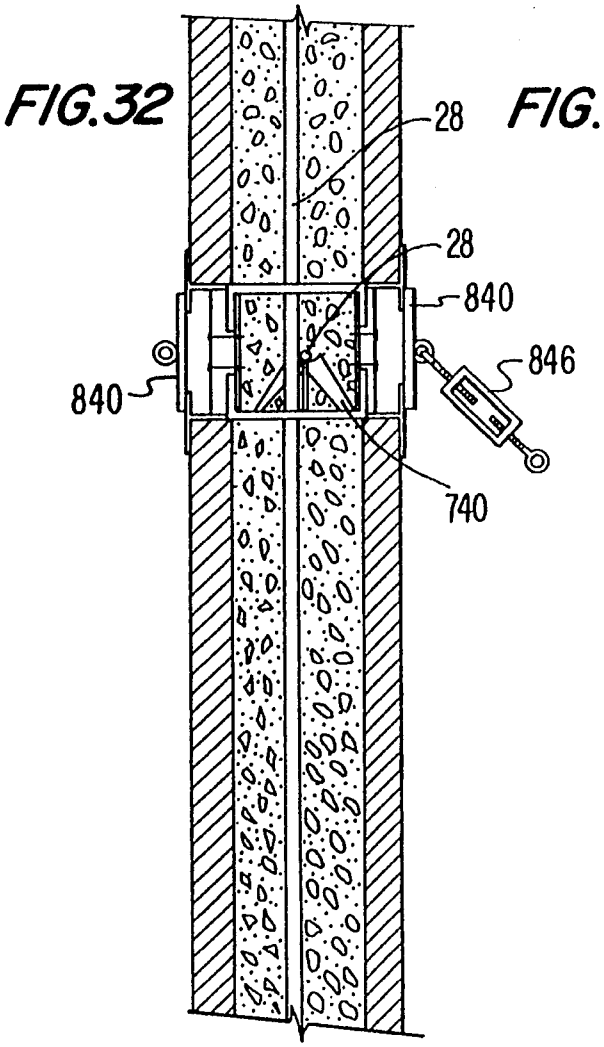
FIG. 32 is a view, similar to FIG. 31, showing a horizontal bond beam section of a wall.

As seen in FIG. 11, The cylindrical aperture in each Insulating Block, when filled with concrete, creates a cylindrical column which is four feet in height (the height of the Insulating Block) and three inches or five inches in diameter (the diameter of the cylindrical aperture). External walls have five-inch concrete columns and internal walls have three-inch columns. The columns 8, which are located below the ground level, are spaced on eight-inch centers, better to withstand hydronic and hydraulic forces. Cylindrical columns 10, located above ground level, are desirably spaced on sixteen-inch centers. Each cylindrical column contains at least one centrally located vertical Rebar 20, as seen in FIGS. 32 to 34. In those places where Rebars are overlapping and spliced, there will be portions of two Rebars in the column, as seen in FIG. 34.

As seen in FIG. 31, in those areas in which a Pilaster 12 is located, a short Rebar 22 is placed, with a vertical lower section (not shown) and an approximately 45-degree-inclined upper section 24. Rebar 22 is spliced to the vertical Rebars 20 by clips 752 and is held securely in place within the slot 172 of the appropriate tie for the adjacent part of the horizontal bond beam channel member. In this way, the 45-degree section 22 of the Rebar 20 extends within the Pilaster, and, by being connected to the Rebars 20 of the vertical columns, completely and satisfactorily provides structural support for the Pilaster to meet applicable Code requirements.

7. Horizontal Bond Beams

Each set of concrete cylindrical columns 8 or 10 is integral and interconnected by horizontal concrete bond beams 6, which have preferred cross-sectional dimensions of five inches deep by six inches high.

As seen in FIG. 32, centrally located within each horizontal bond beam 6 is at least one reinforcing bar 28. Each reinforcing bar is held in place by cradles 740, which are standard and commercially available. The cradles and Rebars are inserted when the wall structure is being created, after the Channel members 110 are inserted in place. Thus, the reinforcing bars are held at the elevation required by the applicable Code, which will vary with the size of the bond beam, so that they are properly placed within the beam.

8. Pilasters

As seen in FIG. 31, the Pilasters 12 serve the same structural purposes as horizontal bond beams 6 but they also support the floor and roof Joists or Tresses 860, seen in FIG. 34. The concrete Pilasters are formed when the open Pilaster Channels 200 are filled with concrete. The Pilaster Channels permit easy access to pour concrete into the otherwise sealed wall structure, because the Pilaster Channels are in fluid communication with the cylindrical apertures 52 and 62 and the horizontal and vertical bond beam Channels 100 and 300. The horizontal Pilaster at each floor or roof level has an integral lip section 14, which is formed by the Pilaster Channel.

If an internal wall is being formed, with rooms on either side of the wall, or if an external structure is to be fastened to an external wall, as where there is to be a porch on the building, there is a double Pilaster instead of a single Pilaster. A double Pilaster Channel is illustrated in FIG. 25. One Pilaster is to support one internal floor or roof. The other Pilaster is to support the other internal floor or the external porch or other structure.

The preferred dimensions of each single Pilaster are twelve inches high, five inches wide at the base and fourteen inches wide at the crown. A double Pilaster has the same height and base width but is preferably twenty two inches wide at its crown.

The angular Rebars 22 in each Pilaster Channel are about ten inches long and are spliced to the vertical Rebars by tie slots 172. The Pilasters also have horizontal Rebars 26 spaced within them. The horizontal Rebars are held in place by being clipped to the vertical Rebar 24 by "cross" clips 750, which are commercially available and come in different sizes for different size Rebars.

9. Vertical Bond Beams

The vertical bond beams are normally eight inches wide, five inches deep and the height is either four feet or eight feet, depending on the size of the vertical bond beam Channel. If the vertical bond beam is used as a structural member, it will be eight feet six inches high and can be up to twenty two inches deep.

Each vertical bond beam is integral with and secured to its adjacent horizontal bond beam by virtue of the interconnecting horizontal reinforcing bars 28 and by virtue of either having been poured in the same pour, or, where a vertical bond beam is connected to a Pilaster which was poured in a previous cycle, the vertical Rebars provide connectivity between pours, when the cure time of the concrete is slow. The vertical bond beams are not normally structurally necessary (unless used as structural members) and may be replaced by vertical cylindrical columns. Indeed, the vertical bond beams are eight inches in width so that, if a vertical bond beam is not desired at a location, a Block is just slid against its adjacent Block; since the cylindrical apertures above the ground are on sixteen inch centers, an eight inch wide scrap section of Blocks is slid in its stead, and the cylindrical apertures remain in alignment.

The normal purpose of the vertical bond beams is to define vertical recesses 760 for vertical plumbing and electrical pipes and wires beneath the Block surfaces. It will usually be desired to install electrical outlets every eight feet in a building, so that vertical bond beams for this purpose are desirable at eight foot intervals. However, plumbing pipes will not be located every eight feet. It is cheaper to extrude vertical bond beams in four feet lengths, rather that eight feet. Thus, in areas where plumbing is to be inserted or if electrical fixtures are to be mounted on a wall more than four feet from the floor, two four foot vertical bond beam Channels and a horizontal splice may be used to provide an unobstructed path.

As seen in FIG. 27, spacer wheels 820 are located in the vertical bond beam Channels, to appropriately locate the reinforcing bars 28 in the vertical bond beams. The spacer wheels are friction fit on the Rebars, which seat in slots 822. The spacer wheels are standard commercial items.

At each overlap of a pair of vertical reinforcing bars, at a splice, as seen in FIG. 31, there should be at least forty bar diameters of overlap, to meet Code requirements. The adjacent sections of the overlapped Rebars may be attached by suitable, commercially available extension clips 752 or held in place by the slots 172 of ties 160. At the intersections of vertical and horizontal reinforcing bars, the Rebars do not have to be fastened to each other to meet Code requirements, to transmit applicable forces throughout the structure, so long as they are contiguous, as seen in FIGS. 27 and 28.

A vertical bond beam may be a structural member, if desired. If, for example, a large window is to be formed in a wall section, one or more structural bond beams may be required. Also, if steel girders are to be used to support a floor or roof, structural bond beams may be needed to support the girders. The size of the vertical bond beam will be varied to suit the structural requirements of the application.

10. Floor and Roof Joist and Truss Anchor Plates

As seen in FIG. 34, the floor and roof Joists or Trusses 860 are nailed or screwed into the wooden anchor plates 862. The anchor plates are fasted with nails or screws 824 extending into the concrete of the Pilasters. The screws or nails of the anchor plates are inserted into the soft concrete of the Pilasters before the concrete sets, or the commercially available concrete joist anchors, with screws or nails inserted, are set in place before the concrete pour. After the concrete sets, the Joists or Trusses are nailed or screwed into the anchor plates, as seen in FIGS. 29 and 34.

11. Corner Connections

As seen in FIGS. 40 and 41, each wall section is separately constructed. Adjacent perpendicular wall sections are connected by the insertion of thirty-inch Rebar lengths 830, horizontally extending through the Insulating Blocks 50 or 60, so that they pass through three cylindrical apertures 52 or 62 in Insulating Blocks of adjacent perpendicular sections, and are securely held in place after the concrete is poured into the cylindrical apertures. The Rebar length must be great enough to pass through one column aperture in one wall section and two column apertures in the perpendicular wall section, as seen in FIGS. 40 and 41. The vertical spacing between these "splice" Rebars 830 is desirably about sixteen inches.

As seen in FIG. 41, at the intersection of the two Pilaster Channels 200, one Pilaster Channel member 220 must be cut two feet short of the corner, capped and the cut section replaced with a second Pilaster Channel member 240. This will create a two foot long horizontal bond beam section at the end of the cut Pilaster Channel. A cross-section of this end Channel section is seen in FIG. 26.

12. Splices. The splices which interconnect vertically and horizontally intersecting Channels, as seen in FIG. 10, allow concrete to flow and form unitary beam intersections as seen, for example, in FIG. 11.

The Process

1. Generally

The process of the invention includes the following steps:

1. Erect a concrete basement or slab form including horizontal bond beam Channel members with horizontal Rebars, to define inner and outer walls.
2. Erect a first course of Insulating Blocks, with optional vertical bond beam Channels, seated above the horizontal bond beam Channels.
3. Erect a second horizontal bond beam Channel course with horizontal Rebars.
4. Erect a second layer of Insulating Blocks with optional vertical bond beam Channels.
5. Erect a Pilaster beam Channel course, with vertical and horizontal interlocked Rebars.
6. As each course is created, insert appropriate splices and end caps.
7. Insert wooden frameworks for doors and windows.
8. Stabilize the first story of the building.
9. Erect a second story in substantially the same manner as the preceding story.
10. Erect, if applicable, a third story.
11. Insert all vertical Rebars, threading them through tie slots.
12. Insert pre-pour fixtures, such as plastic wall anchors, anchor plates, plumbing and electrical wiring yokes and harnesses and junction boxes.
13. Pour the concrete, in a Substantially Continuously Pour, one story at a time.
14. If preferred, insert floor and roof anchor plates with fasteners extended into the partially set concrete of the Pilasters.
15. Allow the concrete to set fully.
16. Remove the stabilizing means.

Interior walls are handled at the same time and in the same manner as the exterior walls, and are erected and stabilized before the concrete is poured.

2. Creating the Foundation

As indicated above, the first step in the erection of a wall structure in accordance with the invention is digging a foundation or a ground slab. The foundation or ground slab is appropriately structurally strengthened by horizontal reinforcing bars, which are mounted on suitable foundation chairs or other elevation devices, as needed to meet Code.

A first course of horizontal bond beam channels, with dowels inserted, is placed around the periphery and the interior (to define interior walls) of the foundation or slab. The horizontal legs of the L-shaped reinforcing bar dowels are located above and can be secured to the horizontal reinforcing bars in the foundation. The vertical portions of the dowels are held in place in the ties 160 of the horizontal bond beam channels. The Channels are inserted above the horizontal reinforcing bars, and are seated on screed chairs which engage in the slot portions 170 of the ties 160.

Appropriate plumbing or other conduits are mounted in the slab or foundation, as is well known in the art and appropriate.

The concrete for the foundation or slab is then poured, up to the level of the upper horizontal flanges 124 and 128 of each bond beam Channel. The concrete is allowed to set for a few hours.

If walls within the building are to be created by the process of the invention, a course of suitable interior horizontal bond beam Channels are mounted in the foundation or slab, before the concrete is poured. The screed chairs 36 are adjusted so that all horizontal bond beam Channels are level. The first course of horizontal bond beam Channels are locked into the concrete foundation or slab and provide a level platform for erecting the wall structures of this invention.

3. Construction of the First Course of Insulating Blocks

Each course is formed in the following fashion.

First, an Insulating Block is placed in the channel formed by the vertical flanges 128 and 130 of each horizontal bond beam Channels of the previous layer or the foundation (as to the first layer). The cylindrical apertures 52 in each Insulating Block are placed over the vertical Reinforcing Bars of the dowels, which are centrally located within each cylindrical aperture by the ties 160, which hold them in place. Each Insulating Block is spaced from its companion by the width of the vertical bond beam, when a vertical bond beam Channel member 300 is inserted between each proximate pair of Insulating Blocks. Otherwise, Blocks are adjacent in those courses or those parts of a course that do not contain a vertical bond beam Channel 300.

A second course of horizontal bond beam Channels 100 is placed above the course of Insulating Blocks, with horizontal Rebars inserted thereon on suitable cradles 810. Vertical bond beam Channel members are next inserted and, if applicable, horizontal bond beam Channel splices 400 are attached to the intersecting vertical bond beam Channels 300.

Horizontal reinforcing bars 28 are placed adjacent to the transverse and proximate vertical reinforcing bars 28 by the use of the spacer wheels 820 and cradles 810.

Open ends of the horizontal Channels are closed by suitable end caps 440.

The next course of Insulating Blocks is then placed within the horizontal bond beam Channel member flanges 122 and 130.

If applicable, vertical bond beam Channels 300' are inserted.

A course of Pilaster Channels 200 is then assembled and placed over the second course of Insulating Blocks. Angle reinforcing bars 22 and horizontal Rebars 26 are inserted in the Pilaster Channels 200, with the lower ends of the angle Rebars extending through the tie slots 72. They are connected by the use of cross clip connectors 750.

Splices 510 and 540 are placed between Pilaster Channels, to form a unitary length along each wall, and the ends of each Pilaster Channel at the end of each wall are capped, using Pilaster caps 560 or 570, or are cut and finished off with a straight section as described above and shown in FIGS. 26 and 40.

After a whole wall structure is assembled, vertical Rebars are inserted and "threaded" through the slots 172 and 272 in the horizontal bond beam ties and Pilaster Channel ties, respectively, and vertical Rebars, with cradles 820 attached, are inserted into the vertical bond beam Channels 300.

4. Stabilization

As seen in FIGS. 31 and 32, suitable wood blocks 840 with guy anchors 842 screwed into them are screwed or nailed into the Pilaster Channel flanges on the inside and outside of the wall. Once the wood blocks are mounted, suitable guy wires or ropes 844 are fastened, with anchors in the ground, and turnbuckles 846 (located at each end of the guy wire) are rotated to tighten and adjust them. In this way, a story or an entire wall may easily be adjusted.

As each story is created, guy wires are attached and the story stabilized. When the entire structure is completed, final adjustments are made.

The number of guy wires or ropes 844 placed on the inside and the outside of the structure will depend on the size of the structure and the number of floors. In a preferred embodiment of the invention, it is desirable to place guy wires with eight feet spacing around the periphery of each story of the wall structure above the ground floor.

Figure 42:
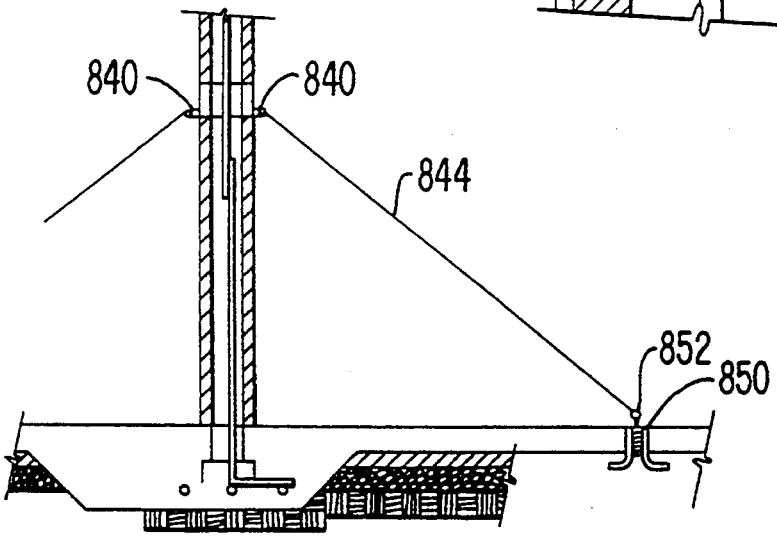
FIG. 42 is a partial cross-sectional view of an internal wall of a building, showing guy wires attached to ferrules cast in the concrete.

Interior walls must be stabilized in the same manner with wooden guy blocks screwed into the Pilaster Channels, turnbuckles and guy ropes or wires. However, to fasten the guy ropes or wires at the ground level, suitable thin slab coil inserts 850 are inserted in the foundation or slab of the building and capped (not shown) before the foundation or slab concrete is poured. They are thereby formed into the concrete and the caps are removed and replaced by loop inserts 852 which are screwed into the coils of the slab inserts and form a secure base to fasten the guy ropes or wires. This is shown in FIG. 42. When the guy wires are removed, the caps may be reinserted. The thin slab inserts and loop inserts are commercial items.

At each corner, between perpendicular walls, reinforcing bars long enough to pass through three columns are inserted. These reinforcing bars are extended through the centers of the cylindrical apertures. In this way, the corners are securely fastened by the reinforcing bars when concrete is poured in the cylindrical apertures and columns are formed. This is illustrated in FIGS. 40 and 41.

Where the reinforcing bars are inserted through the insulating material, it is possible for concrete to leak through the aperture, so the aperture is sealed by the use of a suitable strip of tape 832, such as duct tape, as seen in FIGS. 40 and 41.

In the preferred practice of the invention, each story is assembled, one at a time and, as each story is completed, guy wires are inserted, as described above, to stabilize and level that story.

It may not seem that winds and frame stability are important in a structure of this sort. However, experience has shown that winds can be very significant in destabilizing the wall structure. Accordingly, as each story is formed, it should preferably immediately be stabilized and securely fixed in place, and kept stabilized until the concrete has poured and sufficiently set.

Although guy wires or ropes are shown as an easy, convenient and removable means for effecting this stabilization, other forms of stabilization, such as removable frames and scaffolding, may also be used, but are more cumbersome and expensive.

The entire frame of the wall structure is created in this fashion, until the entire wall structure has been assembled.

5. Inserting Wall Anchors, Junction Boxes, Pipes, Etc.

After the wall structure is stabilized, [???], plastic wall anchors 710 and plumbing, electrical wiring and junction boxes are fastened into the wall structure where and as needed.

Holes 520 are drilled in Pilaster channel members 510 for passage of plumbing pipes (not shown) between floors. Electrical wiring is threaded around the outside of the Pilaster Channels 200 and up the walls.

The plastic wall anchors, junction boxes, wiring harnesses and plumbing yokes are inserted into the corresponding bond beam Channels or Insulating Blocks, as appropriate, extending into the open apertures or Channels, where they will be surrounded with concrete, when it is poured, and then securely locked into the concrete.

The placement of the wall anchors, wiring harnesses, plumbing yokes and junction boxes is obviously up to the choice of the builder.

6. Cutting the Insulating Blocks and Bond Beam Channels

Before the courses are assembled, Insulating Blocks and bond beam Channels are cut to size, to adapt for any building and wall lengths which require less than an eight-foot multiple, and also to make openings for windows and doors. The Blocks and Channel members may be cut using standard hot wires.

In each story in which a window or a door is to be present, the space defining the window or door aperture is closed by securing a suitable 2"×8" board in each side of the opening. Each board seals the adjacent horizontal or vertical channel, to prevent concrete leakage, and provides a surface to fasten the frame of the window or door.

7. Pouring the Concrete

The concrete is formulated for its structural qualities and its fluidity, so that it will easily flow and fill all of the appropriate cavities, and for its set time.

In the invention, in order to minimize construction time for the wall structure, it is desirable to pour all of the concrete walls in a Substantially Continuous Pour; this can be done in one day for most structures created in accordance with the process of this invention, availability of concrete and weather permitting.

The concrete truck arrives, desirably in the morning, and each story is poured, by the introduction of the concrete through the open Pilaster Channels. The concrete flows from the open Pilaster Channels into the adjacent cylindrical apertures and vertical bond beam Channels, which are in fluid communication, and flows into the lower cylindrical apertures and horizontal and vertical bond beam Channels by the plastic flow of the concrete.

If necessary, when the pour is completed, small holes may be drilled in the bond beam Channels and Blocks to assure that the concrete has satisfactorily filled all of the apertures and Channels in the wall.

It is estimated that, for a 1,600-square-foot building, it will take approximately one to two hours to pour one story. Thus, if the building has a basement and two floors, it would take approximately three to six hours to pour the entire building.

8. Insertion of Floor and Roof Joists

Before the concrete has been permitted to set, the anchors plates 862 may be inserted in place. For ease of insertion of suitable fastening means, the ends of the floor and roof joists are pre-drilled (not shown), and screws or nails 864, which extend at least two inches into the concrete, are inserted. After the concrete is fully cured, the floor and roof Joists and Trusses 860 are positioned on the anchor plates, and are securely locked in place by the screws or nails which are locked in the anchor plates 862.

It is desired to allow the structure, while still supported by the guy wires, to remain in place for twenty-four to forty-eight hours or until the concrete is satisfactorily set. This time will obviously vary depending on the particular concrete used and its desired set time.

Once the concrete has been set, the guy wires will be removed by unscrewing the wood plates 840 from the flanges 116 or 216 of the Channel members 110 or 210, for use at a subsequent construction site. For ease of removal, these screws are inserted in the flanges containing the Blocks, not the flanges to be filled with concrete.

Modifications of the Invention

It will be appreciated that a specific, preferred embodiment of the invention has been disclosed, but that numerous modifications may be made without departing from the spirit and scope of this invention. The particular sizes and shapes of the components of the invention and the specific materials which are utilized all may be widely varied without departing from the spirit and scope of the invention.

I claim:

1. A bond beam Channel structure for a wall structure of Blocks reinforced with concrete, comprising:

a pair of Channel members, each Channel member having a substantially C-shaped cross-section defined by a vertical member and a pair of horizontal members projecting away from said vertical member;

a plurality of elongated ties, each tie having two ends, one end connected to one Channel member, the other end connected to the other Channel member, said ties spaced from one another and fixing said Channel members such that said C-shaped cross-sections face away from one another, and defining an open Space between the vertical members of the two Channel members, each tie including a slot configured to receive at least one Rebar in a position substantially transverse to said tie.

2. A bond beam Channel structure as set forth in claim 1, wherein said ties are integral with said Channel members.

3. A Channel structure as set forth in claim 1, further comprising means for securing said ties to said Channel members.

4. A channel structure as set forth in claim 1, wherein each Channel member further includes a flange projecting transversely from each horizontal member.

5. A Pilaster Channel structure, for a beam and ledge in a wall structure of Blocks reinforced with concrete comprising:

a pair of Channel members;

said first Channel member having a substantially C-shaped cross-section comprising a vertical member and first and second horizontal members projecting substantially traversely away from said vertical member, said horizontal members connected to said vertical member at first and second positions which are a first distance apart;

said second Channel member having (i) a vertical member, (ii) a horizontal member projecting away from a first position on said vertical member at a first angle substantially transverse to said vertical member, and (iii) a wall member projecting from a second position on said vertical member at a second angle greater than said first angle and ending in a third position, said first and second positions being a second distance apart which is less than the first distance; and a plurality of elongated ties, each tie having two ends, one end connected to the first Channel member, the other end connected to the second Channel member, said ties spaced from one another and fixing said Channel members relative to one another while defining an open space between the two Channel members, each tie including a slot configured to receive at least one Rebar in a position substantially transverse to said tie.

6. A Channel structure as set forth in claims 1 or 3, wherein each tie is substantially U-shaped and has legs at each end, wherein each said Channel member includes a slot closed by a displaceable flap and wherein each leg of each tie is configured to be inserted in said slot of each Channel member to displace the respective flap and lockingly interconnect the Channel members.

7. A Channel structure as set forth in claims 1 or 3, wherein each tie is substantially flat and includes fasteners for fastening each tie to the Channel members wherein said fasteners are selected from the group consisting of screws, nails, and rivets.

8. An article as set forth in claim 1 or claim 3, wherein said ties are integral with said Channel members.

9. A Channel structure as set forth in claims 1 or 3, wherein said slot is generally L-shaped and is configured to receive at least three Rebars.

10. An article as set forth in claim 1 or claim 3, wherein said Channel members are constructed of sheet metal or thermoplastic.

11. A Channel structure as set forth in claim 3, wherein a distance of the space between the two Channel members at the respective first positions is at least about on-and-one-half times a distance of the space between the second position of the first Channel member and the third position of the second Channel member.

12. A Channel structure as set forth in claims 1 or 3, further comprising a splice member for splicing two adjacent Channel structures together.

13. A Channel structure as set forth in claim 12, wherein said splice member has two ends, each end configured to seat in the substantially C-shaped cross-sections of corresponding Channel members of the adjacent Channel structures.

14. A Channel structure as set forth in claim 13, wherein each tie is substantially U-shaped and has legs at each end, wherein each Channel member includes a slot, wherein each splice member includes a slot positioned to fit beneath the slot on the Channel member, and wherein each leg of each tie is configured to be inserted in the slot of one said Channel member and one said splice member to lockingly interconnect the Channel member and splice member.

15. A Channel structure as set forth in claims 1 or 3, wherein the Channel structure has distal ends, and further comprising means for capping at least one said distal end.

16. A Channel structure as set forth in claim 3, wherein said first Channel member further includes a flange projecting transversely from said first horizontal member.

17. A Channel structure as set forth in claim 16, further comprising an elongated bar with a projecting flange portion, disposed on said ties with said projecting flange portion substantially parallel to said flange projecting from said first horizontal member of said first Channel member.

18. A Channel structure as set forth in claim 17, wherein a distance between said projecting flange portion of said elongated bar and said flange of said first Channel member is substantially equal to a width of the Blocks.

19. A Channel structure as set forth in claims 1 or 3, wherein said slot is positioned midway between the two ends of each tie.

20. A Pilaster Channel structure for a wall structure of Blocks reinforced with concrete, comprising:

two opposing, elongated Channel members, each having a base, an upper section and a lower section; and a plurality of ties securing the Channel members substantially parallel with one another with an open space therebetween;

wherein a first distance between the upper sections of said Channel members is at least about one-and-one-half times a second distance between said lower sections of said Channel members, whereby the Pilaster Channel structure, when filled with concrete, is configured to create a ledge extending beyond the Blocks.

21. A Channel structure as set forth in claim 20, wherein each Channel member further comprises a lip portion projecting from said lower section, and a distance between said lip portions of said two Channel members is substantially equal to a width of one of the Blocks.

22. A Channel structure according to claim 20, wherein said ledge is adapted to support a floor or roof structure.

23. A Pilaster Channel structure for a wall structure of Blocks reinforced with concrete, comprising:

two opposing, elongated Channel members, each having a base, an upper section, and a lower section; and a plurality of ties securing the Channel members with the bases substantially parallel with one another, defining an open space between the Channel members;

wherein a first distance of the open space between the upper sections of said Channel members is greater than a second distance of the open space between said lower sections of said Channel members, whereby the Pilaster Channel structure, when filled with concrete, is configured to create a ledge extending beyond the Blocks.

* * * * *

UNITED STATES PATENT AND TRADEMARK OFFICE

CERTIFICATE OF CORRECTION

PATENT NO. : 5,371,990

DATED : 12/13/94

INVENTOR(S) : Fareed M. SalahUddin

It is certified that error appears in the above-indentified patent and that said Letters Patent is hereby corrected as shown below:

Claim 6, col. 31, line 19 change,
"3" to --5--.

Claim 7, col. 31, change,
"3" to --5--.

Claim 8, col. 31, line 31, change,
"3" to --5--.

Claim 9, col. 31, line 33, change,
"3" to --5--.

Claim 10, col. 31, line 36, change,
"3" to --5--.

Claim 11, col. 31, line 39, change,
"3" to --5--.

Claim 12, col. 31, line 47, change,
"3" to --5--.

Claim 15, col. 32, line 1, change "3" to --5--.

Claim 16, col. 32, line 5, change "3" to --5--.

UNITED STATES PATENT AND TRADEMARK OFFICE

CERTIFICATE OF CORRECTION

PATENT NO. : 5,371,990

DATED : December 13, 1994

INVENTOR(S) : Fareed M. SalahUddin

It is certified that error appears in the above-indentified patent and that said Letters Patent is hereby corrected as shown below:

Claim 19, col. 32, line 20, change "3" to --5--.

Signed and Sealed this

Eighteenth Day of April, 1995

Bruce Lehman

*Attest:*

BRUCE LEHMAN

*Commissioner of Patents and Trademarks*

*Attesting Officer*